US010982445B2

(12) United States Patent
Jenkins et al.

(10) Patent No.: US 10,982,445 B2
(45) Date of Patent: Apr. 20, 2021

(54) PANEL FOR USE AS EXTERIOR COVERING FOR ROOFING OR SIDING AND BUILDING STRUCTURE HAVING SAME

(71) Applicant: CertainTeed LLC, Malvern, PA (US)

(72) Inventors: Robert L. Jenkins, HoneyBrook, PA (US); Stephen A. Koch, Collegeville, PA (US); Husnu M. Kalkanoglu, Swarthmore, PA (US)

(73) Assignee: CertainTeed LLC, Malvern, PA (US)

( * ) Notice: Subject to any disclaimer, the term of this patent is extended or adjusted under 35 U.S.C. 154(b) by 0 days.

(21) Appl. No.: 15/942,381

(22) Filed: Mar. 30, 2018

(65) Prior Publication Data

US 2018/0355615 A1 Dec. 13, 2018

Related U.S. Application Data

(63) Continuation of application No. 12/556,980, filed on Sep. 10, 2009, now abandoned.

(51) Int. Cl.
*E04D 1/26* (2006.01)
*E04B 7/22* (2006.01)
(Continued)

(52) U.S. Cl.
CPC ..... *E04D 1/265* (2013.01); *E04B 7/22* (2013.01); *E04D 1/2914* (2019.08); *E04D 3/35* (2013.01); *E04D 3/351* (2013.01)

(58) Field of Classification Search
CPC ..... E04D 1/265; E04D 3/35; E04D 3/358; E04D 3/18; E04D 2001/005; E04D 1/10;
(Continued)

(56) References Cited

U.S. PATENT DOCUMENTS 2,250,482 A * 7/1941 Harshberger ..... E04D 1/265 428/168
2,660,217 A 11/1953 Lawson
(Continued)

FOREIGN PATENT DOCUMENTS

FR 2557904 A1 * 7/1985 ..... E04C 2/30

OTHER PUBLICATIONS

Machine translation of foreign reference FR 2557904, obtained from http://translationportal.epo.org/emtp/translate/?ACTION=description-retrieval&COUNTRY=FR&ENGINE=google&FORMAT=docdb&KIND=A1&LOCALE=en_EP&NUMBER=2557904&OPS=ops.epo.org/3.2&SRCLANG=fr&TRGLANG=en (last accessed on Sep. 10, 2019) (Year: 2019).*
(Continued)

*Primary Examiner* — Theodore V Adamos
(74) *Attorney, Agent, or Firm* — McDonnell Boehnen Hulbert & Berghoff LLP

(57) ABSTRACT

A building panel of the roofing or siding type is disclosed, as well as a building structure having such roofing or siding panels, in which the panels are comprised of two different types of building materials. The composite panel includes at least one layer of synthetic polymeric building material, having adhesively secured thereto at least one layer of asphalt based building material, with outer, upper surfaces of the panel, that would be weather-exposed in the installed condition on a building structure being comprised of the asphalt based building material, and with the synthetic polymeric layer(s) of polymeric building material being weather-protected in the installed condition on a building structure.

20 Claims, 16 Drawing Sheets

(51) Int. Cl.
*E04D 3/35* (2006.01)
*E04D 1/00* (2006.01)

(58) Field of Classification Search
CPC .. E04D 3/351; E04D 1/24; E04D 1/29; E04D 1/2907; E04D 1/20; E04D 3/32; E04D 1/26; E04D 1/2914; B32B 2419/06; E04B 7/22
USPC ..... 52/554–559
See application file for complete search history.

(56) References Cited

U.S. PATENT DOCUMENTS 2,874,980 A 4/1975 Richards
3,943,677 A * 3/1976 Carothers ..... E04D 1/265 52/309.4
4,028,450 A * 6/1977 Gould ..... E04D 1/265 264/45.5
4,191,722 A * 3/1980 Gould ..... B29C 44/12 249/96
4,274,243 A 6/1981 Corbin
4,307,552 A 12/1981 Votte
4,343,126 A * 8/1982 Hoofe, III ..... E04D 1/265 52/313
4,352,837 A 10/1982 Kopenhaver
4,396,665 A 8/1983 Rowe
4,848,057 A 7/1989 MacDonald
4,856,251 A 8/1989 Buck
4,944,818 A * 7/1990 Dybsky ..... B32B 11/02 156/71
5,072,562 A * 12/1991 Crick ..... E04D 1/265 52/521
5,181,361 A 1/1993 Hannah
5,287,669 A 2/1994 Hannah
5,347,784 A * 9/1994 Crick ..... E04D 1/265 52/314
5,347,785 A 9/1994 Terrenzio
5,375,491 A 12/1994 Hannah
5,421,134 A 6/1995 Hannah
5,426,902 A 6/1995 Stahl
5,837,363 A 11/1998 Colafati
5,906,840 A 5/1999 Bosler
D414,568 S * 9/1999 Hedges ..... B29C 44/12 D25/143
6,038,826 A 3/2000 Stahl
6,044,608 A 4/2000 Stahl
6,205,734 B1 3/2001 Kalkanoglu
6,418,692 B1 7/2002 Freshwater
6,467,235 B2 10/2002 Kalkanoglu
6,523,316 B2 2/2003 Stahl
6,530,189 B2 * 3/2003 Freshwater ..... E04D 1/30 52/199
6,808,785 B1 10/2004 Friedman
6,920,730 B2 7/2005 Becker
6,939,036 B2 9/2005 Beck
7,048,990 B2 5/2006 Koschitzky
7,125,601 B1 10/2006 Pinault
7,140,153 B1 11/2006 Humphreys
7,141,200 B2 11/2006 MacKinnon
7,141,201 B2 11/2006 Kim
7,351,462 B2 4/2008 Friedman
7,805,905 B2 10/2010 Rodrigues
7,934,346 B2 5/2011 MacKinnon
2004/0241476 A1 12/2004 Friedman
2005/0193673 A1 * 9/2005 Rodrigues ..... B32B 3/06 52/518
2008/0083186 A1 * 4/2008 Gaudreau ..... E04D 1/265 52/520
2008/0236079 A1 * 10/2008 MacKinnon ..... B24B 1/007 52/311.1
2017/0218632 A1 * 8/2017 Patki ..... E04D 1/16

OTHER PUBLICATIONS

Copending U.S. Appl. No. 12/556,980, filed Sep. 10, 2009 (now abandoned).

* cited by examiner 50
51
41
40
12
10
30
11
24
34
33
25
28
27
37
38
36
26
42
35
II
17
32
III
43
13
18
15
14
44
23
20
22
16

PANEL FOR USE AS EXTERIOR COVERING FOR ROOFING OR SIDING AND BUILDING STRUCTURE HAVING SAME

BACKGROUND OF THE INVENTION

In the art of shingle and siding manufacture, it is known to manufacture shingles of an asphalt impregnated organic or inorganic web, having granules on an outer surface thereof, and having smaller particles on an opposite surface, comprising complete layers of shingle material, examples of which are present in U.S. Pat. Nos. 4,352,837; 5,181,361; 5,287,669; 5,347,785; 5,375,491; 5,421,134; 5,426,902, as well as many other patents. Sometimes, these shingles are comprised of a plurality of complete layers of shingle material, adhered together as a laminate, and sometimes they are comprised of a single complete layer of shingle material, with or without an overlay comprised of an additional layer of adhesive, and an additional layer of granules applied thereto. In addition to structures such as the above identified shingles functioning as shingles, sometimes similar structures are used to function as components of siding, to be applied to side walls of a building structure, rather than the roof of a building structure.

It is also known in the building materials art, wherein materials are adapted for use as an exterior covering for roofing or siding, to construct such building materials from thermoplastic materials, especially where the thermoplastic materials are molded, and allow for designing into the molded thermoplastic building materials, various aesthetic, weather resistant, flame retardant, antifungal and like features. Examples of such building products that are manufactured from thermoplastic materials include U.S. Pat. Nos. 6,808,785; 7,351,462; 7,141,200; 7,141,201 and other synthetic shingles or tiles comprised of a polymeric material.

All of the patents identified above are herein incorporated by reference.

THE PRESENT INVENTION

The present invention provides a panel of building material for use an exterior covering for roofing or siding, for installation on a building structure, wherein the panel is comprised of at least one base layer of a molded synthetic polymeric building material that is adapted to be weather-protected in the installed condition on a building structure, and at least one layer of asphalt based building material outside the base layer(s) that is adapted to be weather-exposed when installed on a building structure.

The asphalt based building material layer(s) is preferably comprised of a layer of mat that is impregnated with an asphalt material, and has a layer of granules on an outer surface thereof, adhesively secured to the mat. The asphalt based building material may be in the form of, or give the appearance of shingles or tiles, in a plurality of horizontal courses, and within a given course, there may be lines of demarcation between separate shingles or tiles, such as a plurality of generally vertical, usually parallel slots or simulated slots comprised of generally parallel lines between what would appear to be individual shingles or tiles.

Accordingly, it is an object of this invention to provide a panel of building material for use as an exterior covering for roofing or siding, that is comprised of at least one base layer of a molded synthetic polymeric material, and at least one layer of asphalt (bituminous) based building material having selected exterior configuration in the form of actual or simulated individual shingles or tiles, with the panel being sufficiently large to encompass or simulate a number of individual shingles or tiles.

It is another object of this invention to accomplish the foregoing object, wherein at least one edge of the panel is adapted to overlap or underlap an adjacent panel alongside or above or below the panel, in lapped relation, when installed on a building structure.

It is a further object of this invention to accomplish the above objects, wherein a synthetic, polymeric base layer may have a transverse lip relative to the remainder of said layer, to engage and support an edge of an asphalt based layer of building material thereagainst.

It is a further object of this invention to accomplish the above objects, wherein the panel lends itself to a large panel size.

It is yet another object of this invention to accomplish the above objects, wherein a substantial weight savings can be obtained from the use of one or more base layers that, while supporting the asphalt based building material layer(s) can do so at a reduced panel weight as compared with a panel entirely constructed of asphalt based building materials.

Other objects of the invention include the production of panels that lend themselves to aesthetic presentations of shingles or tiles with many variations, including portions of different thickness, portions that are at different angles relative to each other to produce random-appearing effects, portions that are parallel or non-parallel to each other, portions at different planes, portions with straight edges, random edges or staggered edges, portions with slots in an asphalt based outer layer that allow for a darkened layer therebeneath to be visible through the slots, portions that allow a darker petticoat lower layer to be visible along a lower edge of a simulated individual shingle or tile that is comprised of the outer-most asphalt based layer, as well as many other variations.

It is a further object of this invention to provide a panel of building material, wherein an asphaltic outer layer is supported by at least one base layer of polymeric material, wherein the base layer has airflow zones therein for facilitating the passage of air therethrough, and/or wherein the base layer is provided with insulation.

Another object of this invention is to provide a panel in accordance with any of the above objects, including a temperature sensor carried by the panel, which panel is subject to expansion and contraction as a function of temperature, and which sensor gives a visual indication of thermal expansion or contraction characteristics at a given temperature of the panel.

It is yet another object of this invention to provide a panel in accordance with any of the above objects, including wires and suitable connections therefore in the base layer, for transmitting photovoltaic energy through the panel and/or to or through adjacent panels.

It is another object of this invention to provide a building structure of the roof or siding type, having an exterior covering that is comprised of a plurality of panels in accordance with any of the objects set forth above.

Other objects and advantages of the present invention will be readily apparent upon a reading of the following brief descriptions of the drawing figures, the detailed descriptions of the preferred embodiments, and the appended claims.

BRIEF DESCRIPTIONS OF THE DRAWING FIGURES

Figure 17:
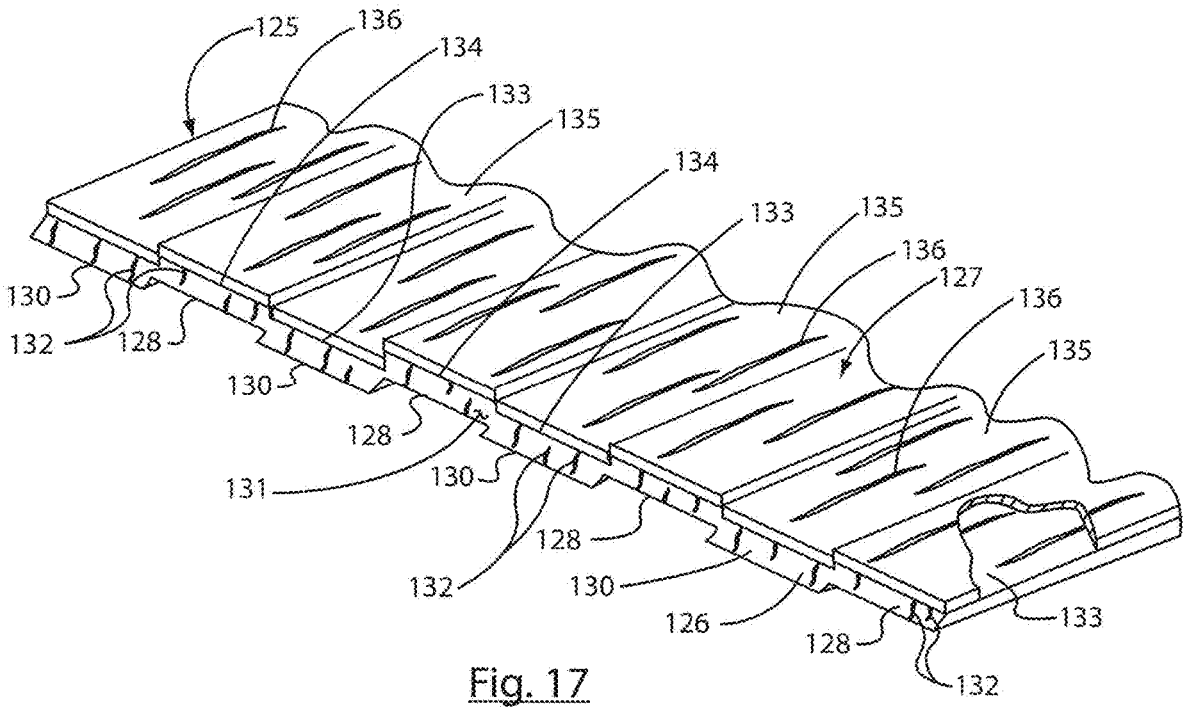

FIG. 17 is a fragmentary perspective view of a panel in accordance with this invention, wherein the base layer has a plurality of planar configurations, and wherein the top, asphalt based layer likewise has a plurality of planar configurations, and with the lower edge of the base layer having certain desired ornamentation thereon, and wherein the outer, upper surface of the asphalt based layer of building material likewise has a certain selected ornamentation therein, and giving a staggered appearance simulating natural shakes or tiles, and wherein a portion of the outer layer of asphaltic material is broken away at the right end thereof, to show a surface of the underlying base layer therebeneath.

Figures 1, 1A, 2, 3:
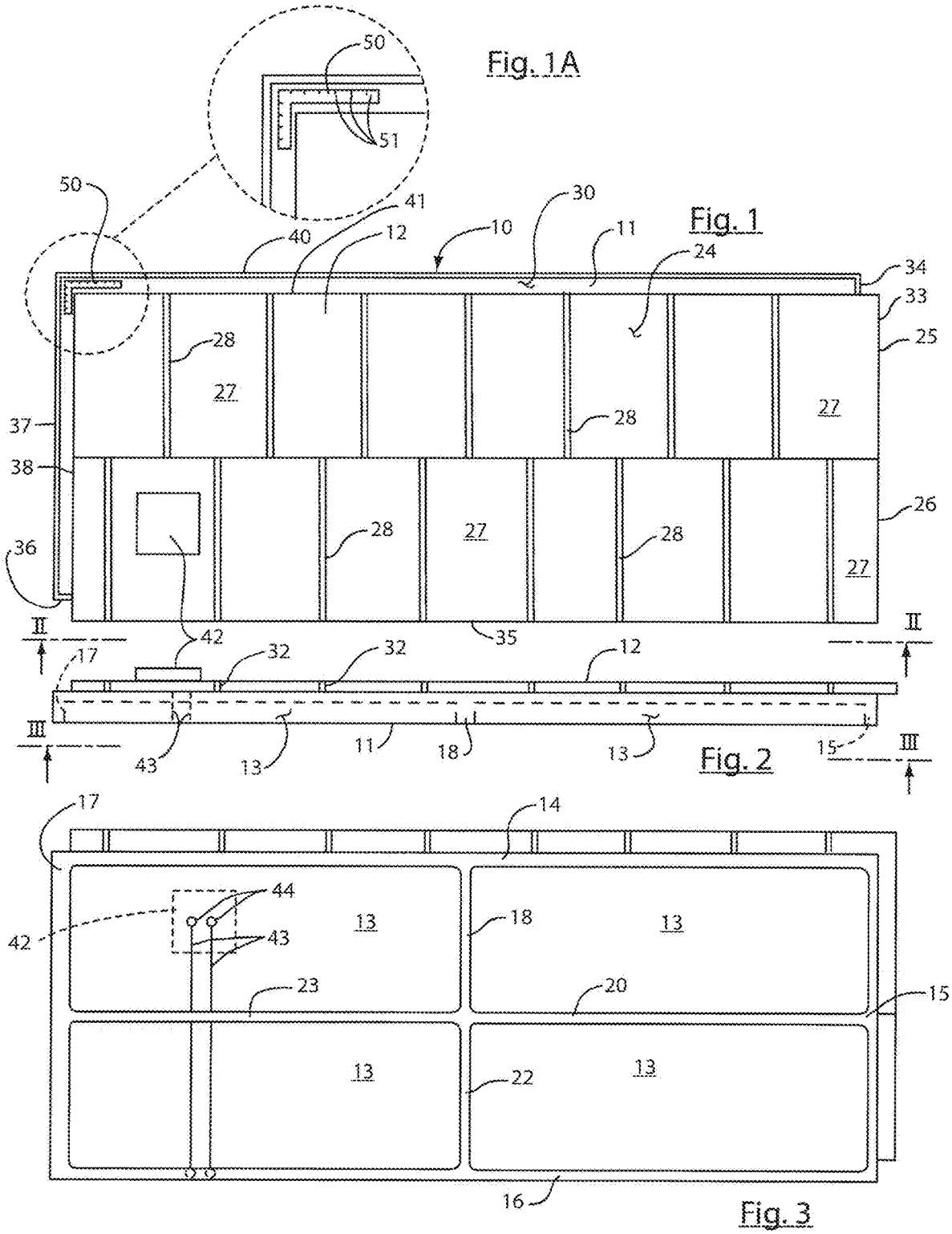
FIG. 1 is a top view of a panel in accordance with this invention.
FIG. 1A is an enlarged view of an upper left portion of FIG. 1, enlarged to illustrate the detail of a temperature sensor thereon.
FIG. 2 is a bottom edge view of the panel of FIG. 1, taken generally along the line II-II of FIG. 1.
FIG. 3 is a rear view of the panel of FIG. 1, taken generally along the line III-III of FIG. 2.
Figure 18:
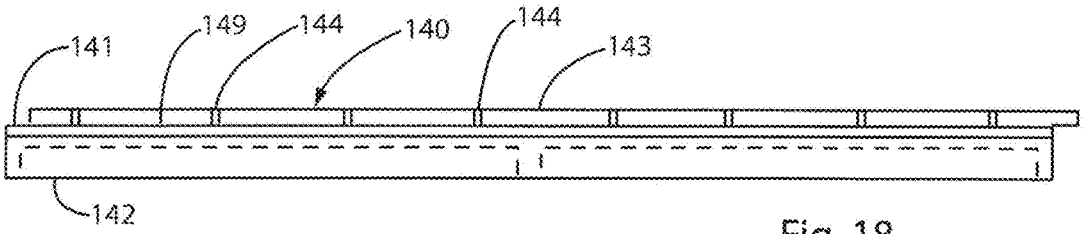

FIG. 18 is an illustration somewhat similar to that of FIG. 2, but having a plurality of base layers of molded synthetic polymeric building material.

Figure 19:
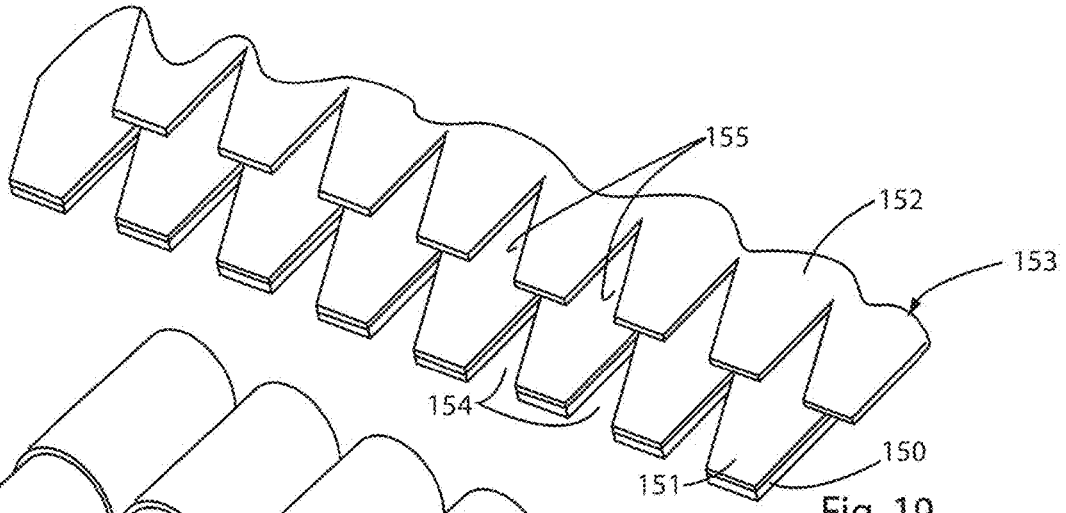

FIG. 19 is a fragmentary perspective illustration of a panel in accordance with this invention, wherein tabs of the asphalt based building material have a certain ornamentation.

Figure 20:
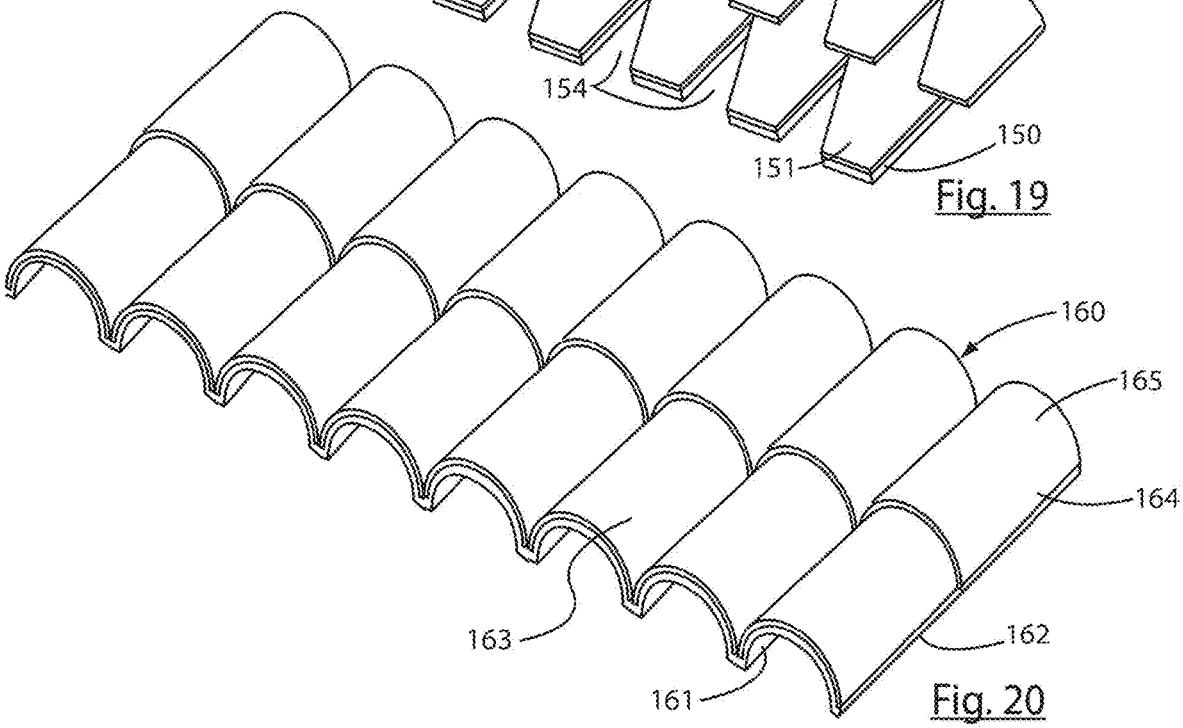

FIG. 20 is a top perspective view of a panel in accordance with this invention, wherein the base and asphaltic layers are in the form of barrel tiles.

Figure 21:
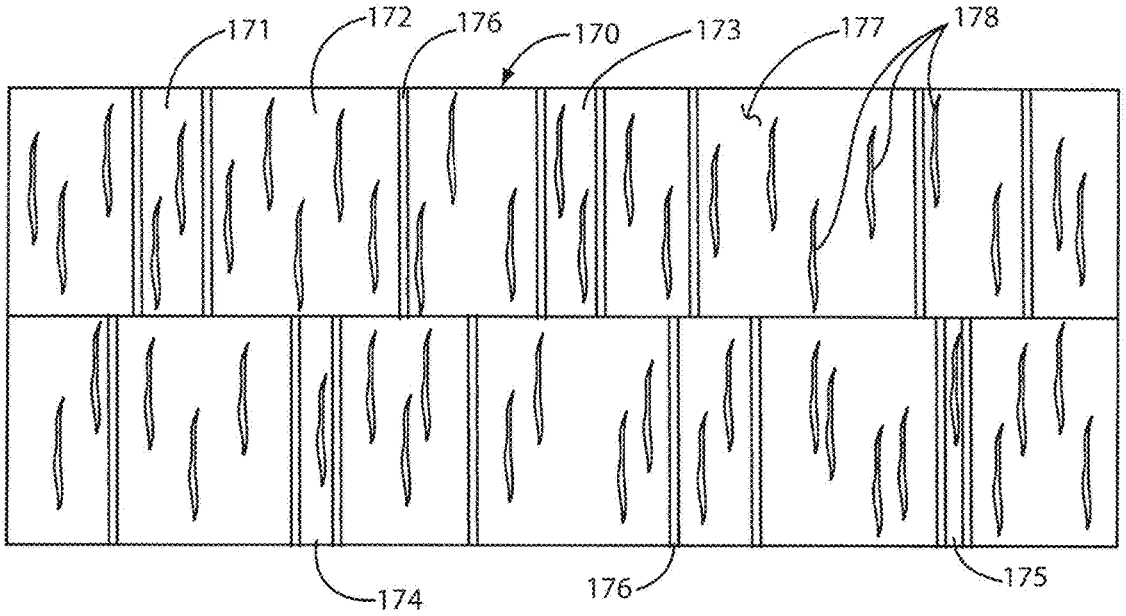

FIG. 21 is a top view of a panel in accordance with this invention, wherein lines of demarcation that are visible from the top surface simulate shingles or tiles that are of various widths, and wherein selected surface configuration is illustrated thereon, simulating natural materials.

Figure 22:
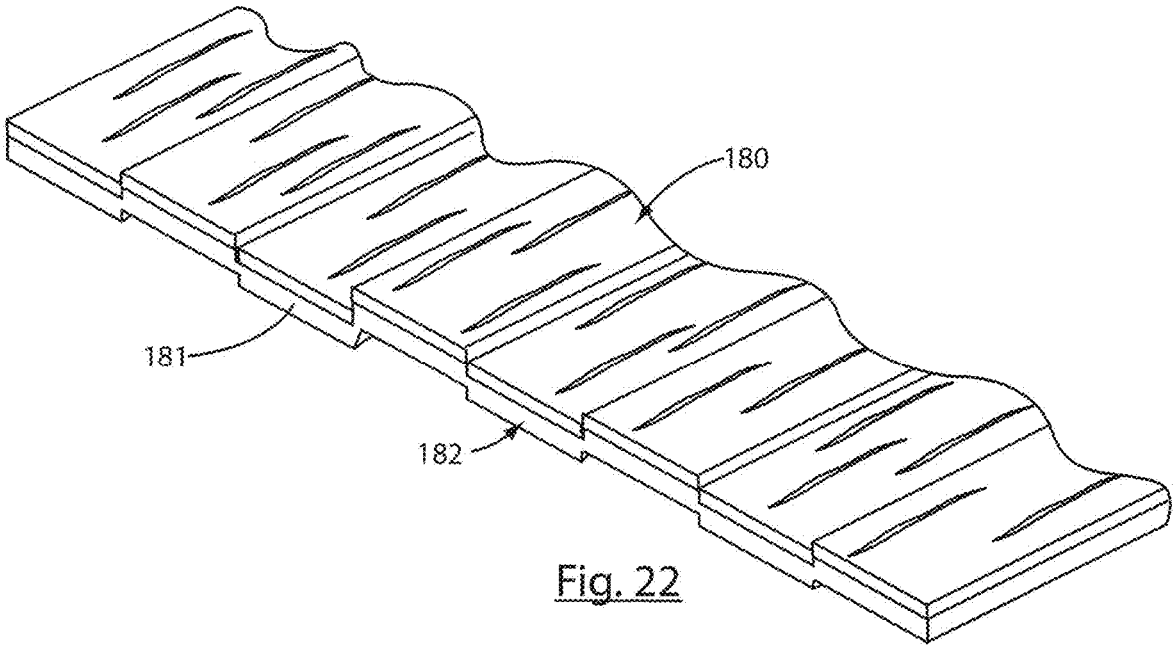

FIG. 22 is a fragmentary top perspective illustration of another panel of this invention, presented somewhat similar to the illustration of FIG. 17, but without the lower edge ornamentation that is provided for the base layer of building material illustrated in FIG. 17.

Figure 23:
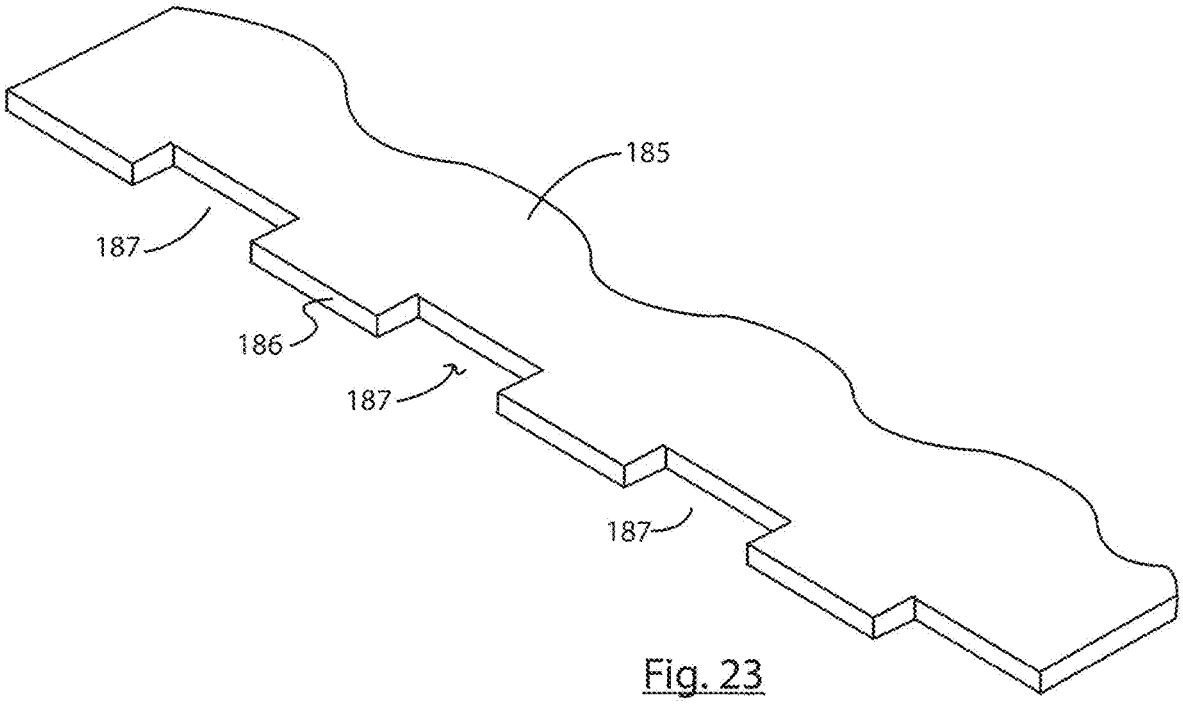

FIG. 23 is a fragmentary top perspective illustration of a layer of asphalt based building material for comprising an outer layer of a panel in accordance with this invention, but wherein the asphalt based layer is illustrated as simulating a single shingle, with no delineation simulating slots or actual slots between various portions thereof.

Figure 3A:
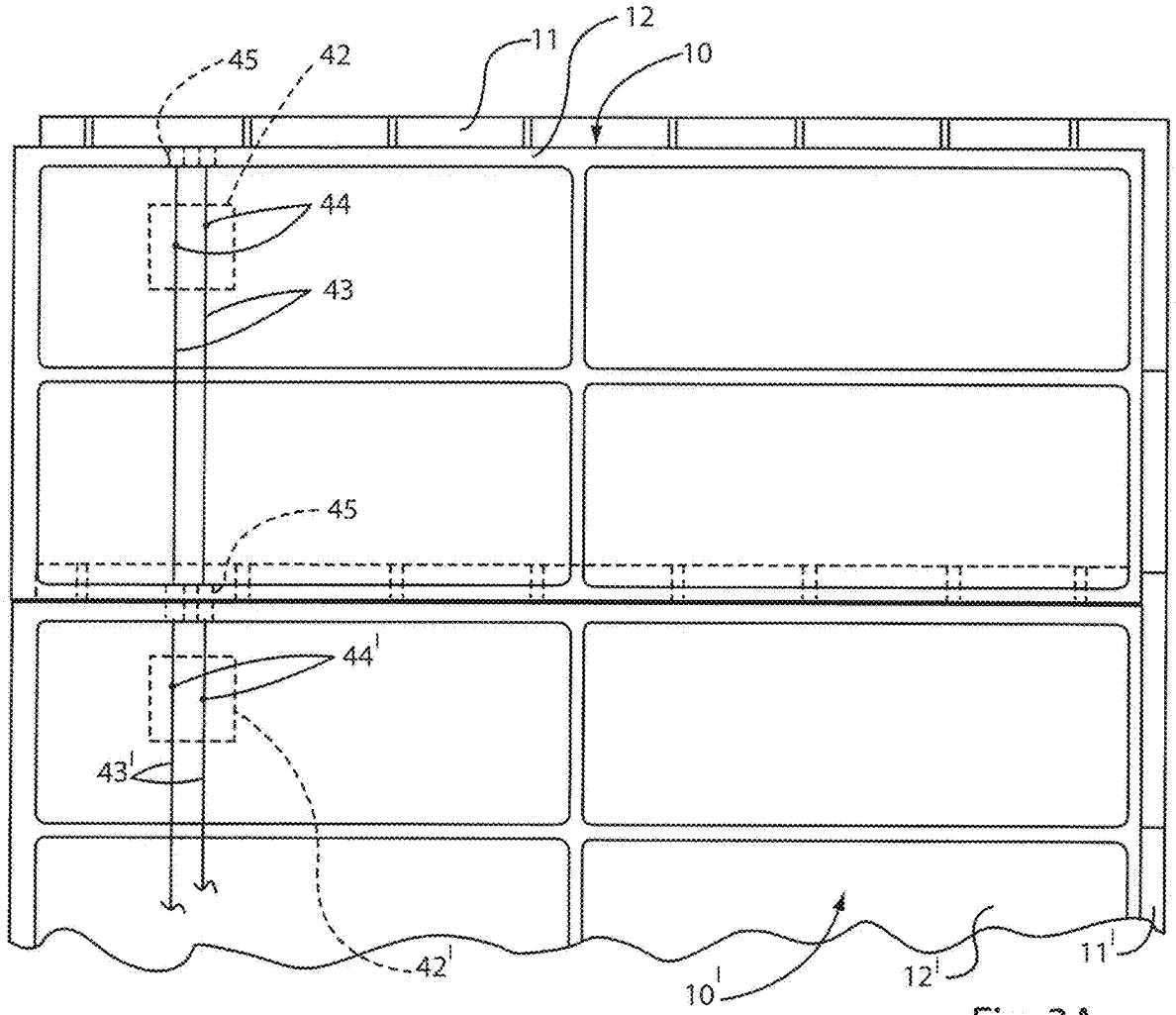
FIG. 3A is an illustration like that of FIG. 3, but wherein a plurality of panels of the FIG. 3 type are illustrated, with the lower-most panel being fragmentally illustrated, and wherein wires for transmission of photovoltaic energy through the base layer of the panel are illustrated, including connections for the wires between adjacent panels.
Figure 24:
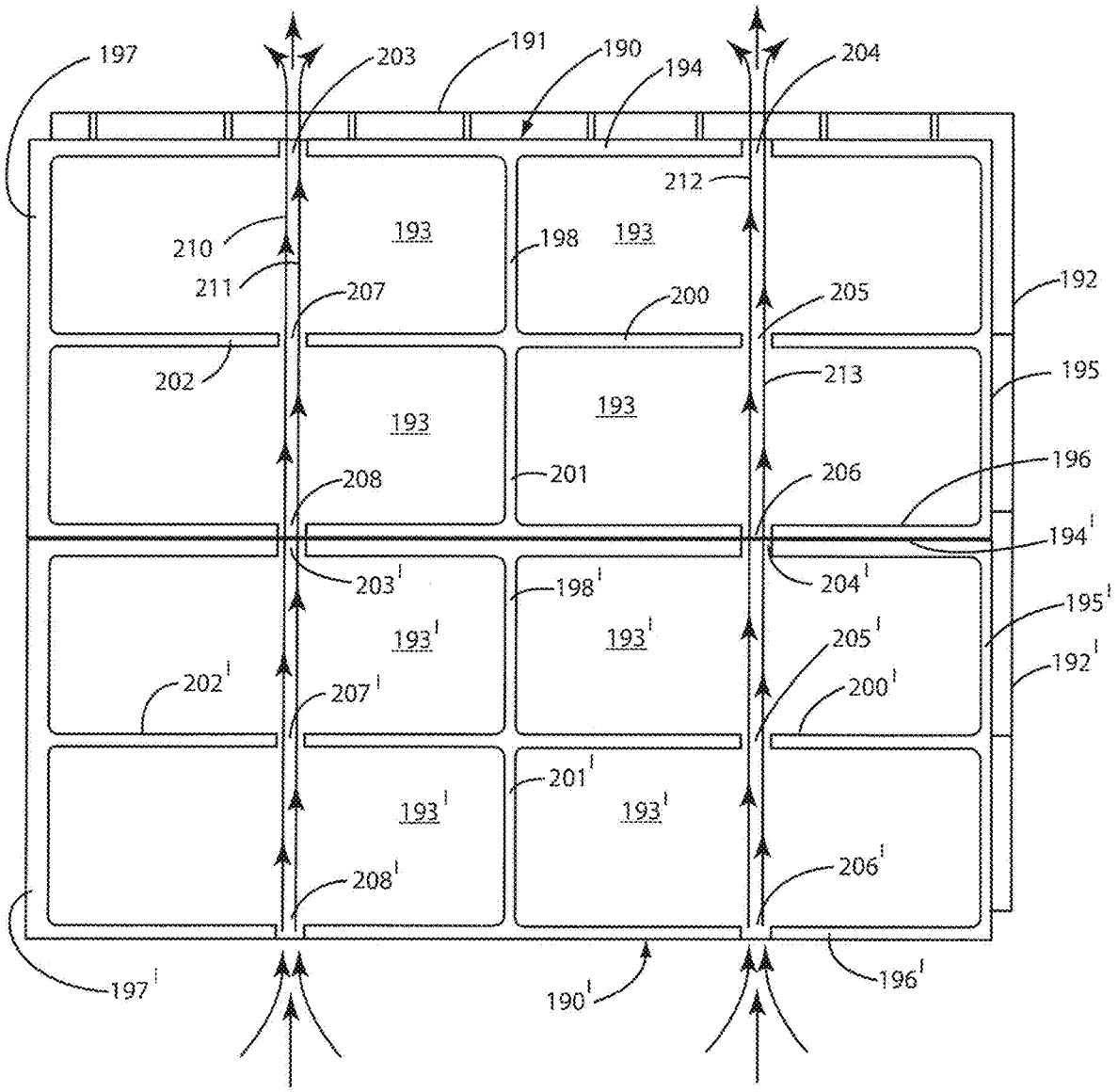

FIG. 24 is an illustration of a pair of vertically adjacent panels, somewhat similar to that of FIG. 3A, but wherein channels are provided within and between adjacent upper and lower panels allowing for air ventilation between the panels.

Figure 25:
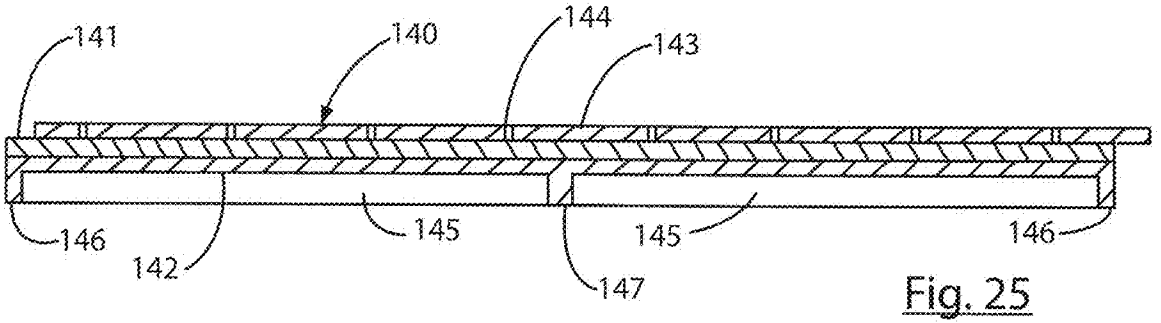

FIG. 25 is a vertical cross-sectional view of a panel in accordance with this invention, comprising a single layer of asphalt based building material disposed over a pair of layers of polymeric based building material, wherein left and right edges of the base layers of building material have a given configuration.

Figure 26:
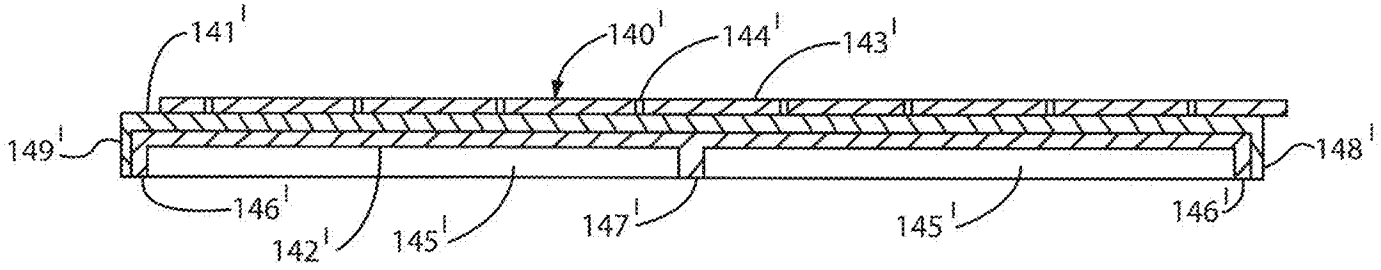

FIG. 26 is an illustration similar to that of FIG. 25, but wherein the right and left edges of the upper polymeric based layer of building material have an alternative configuration to that of FIG. 25.

Figure 27:
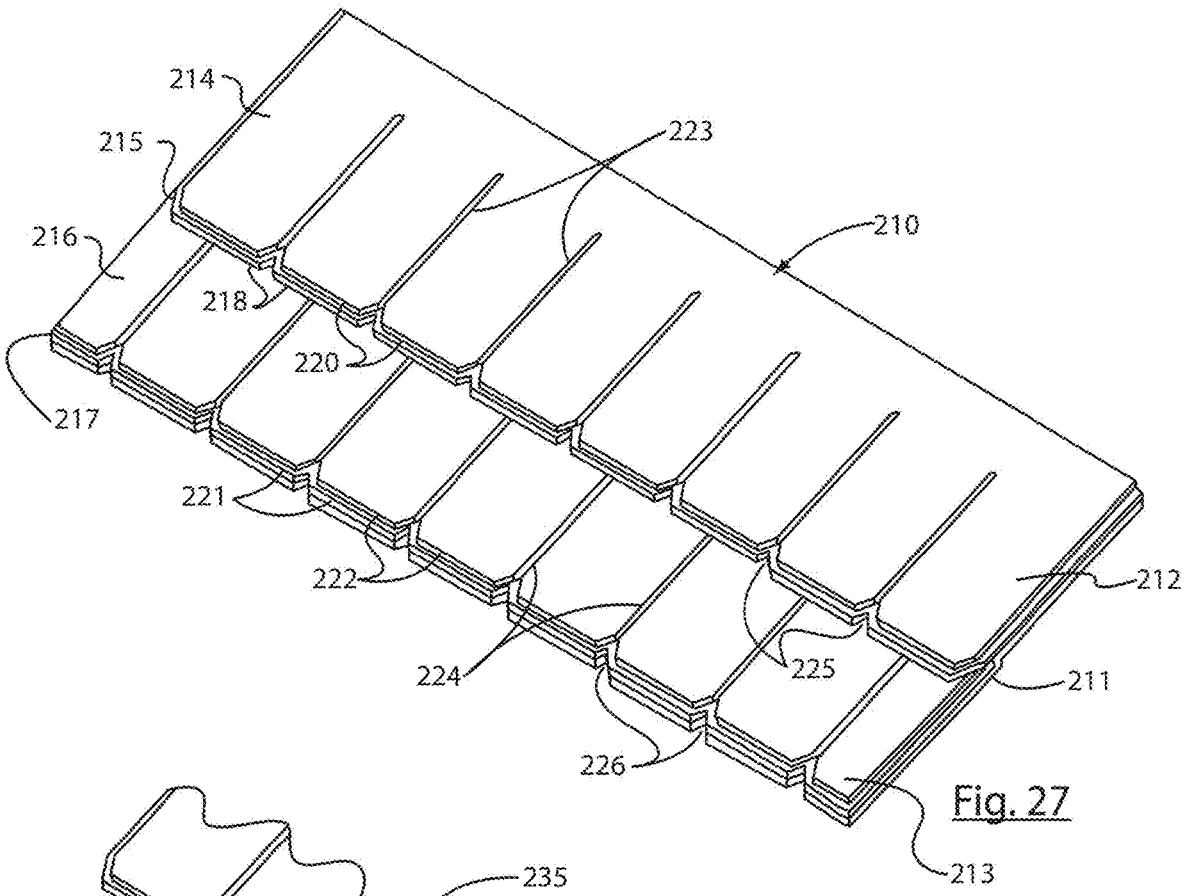

FIG. 27 is a top and lower edge perspective view of a panel in accordance with this invention, wherein the individual tabs of shingles or tiles have notches disposed at lower ends of slots between adjacent simulated shingles or tiles.

Figure 28:
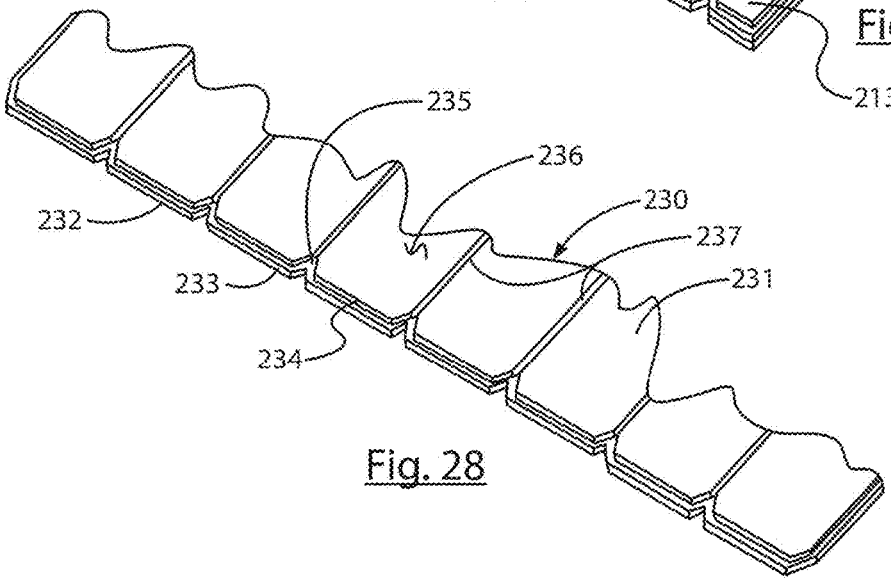

FIG. 28 is a fragmentary perspective view of a panel in accordance with this invention, but wherein the base layer of polymeric material protrudes beyond the lower edge of the upper layer of asphalt based building material, providing a petticoat effect.

Figure 29:
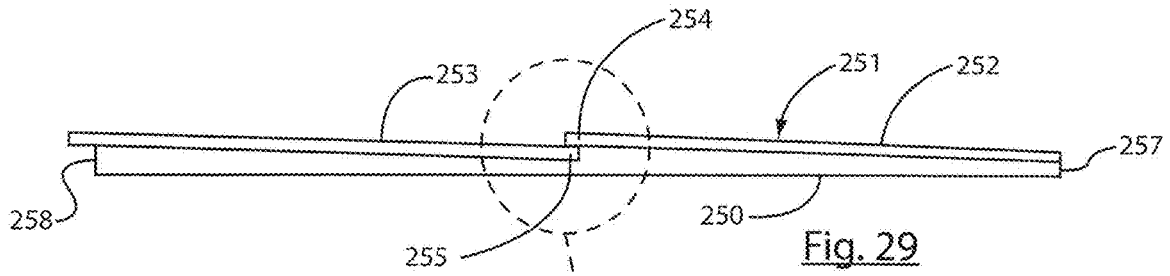

FIG. 29 is a side edge view of a panel of building material in accordance with this invention, wherein a polymeric based lower layer is provided with a pair of asphalt based building material portions, slightly overlapping where the asphalt based building material portions meet.

Figure 29A:
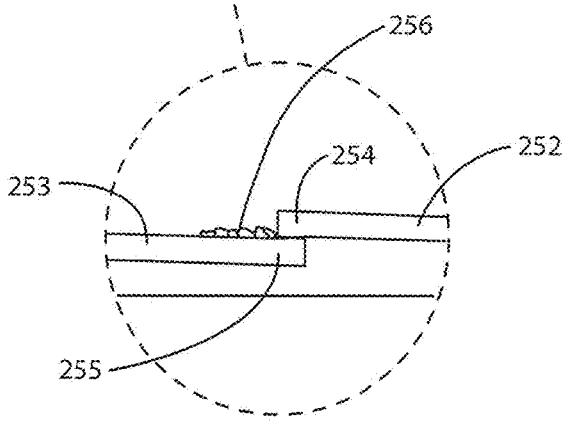
Figure 30:
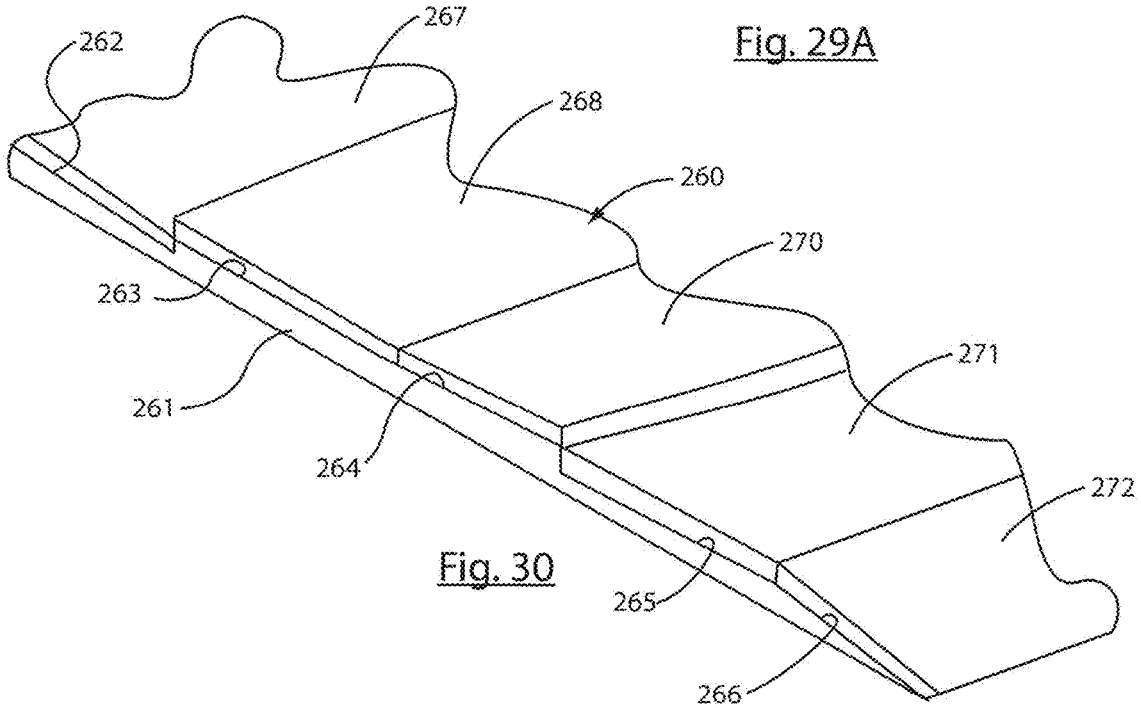

FIG. 29A is an enlarged detail illustration of a portion of FIG. 29, wherein the asphalt based building material layers meet, and wherein a shadow line effect is provided in the form of an overlay of adhesive and granules, to the left of the rightmost layer of asphalt based building material FIG. 30 is a fragmentary perspective view of a panel in accordance with this invention, wherein the base layer of polymeric building material is provided with planes having different angular relations, and wherein the asphalt based building material is disposed thereover.

Figure 31:
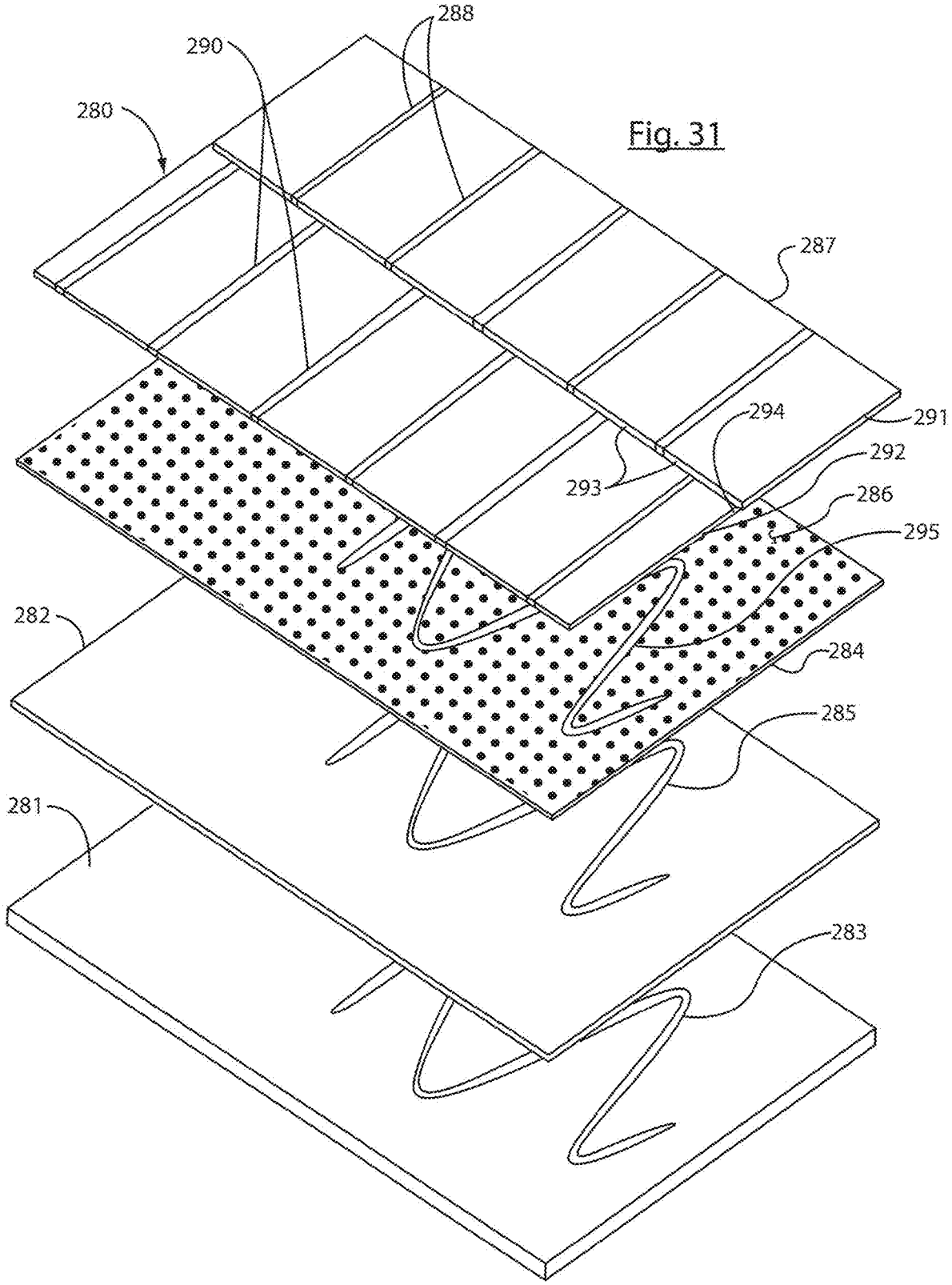

FIG. 31 is an exploded perspective view of a panel in accordance with this invention, comprising a plurality of base layers and a plurality of layers of asphalt based material.

Figure 32:
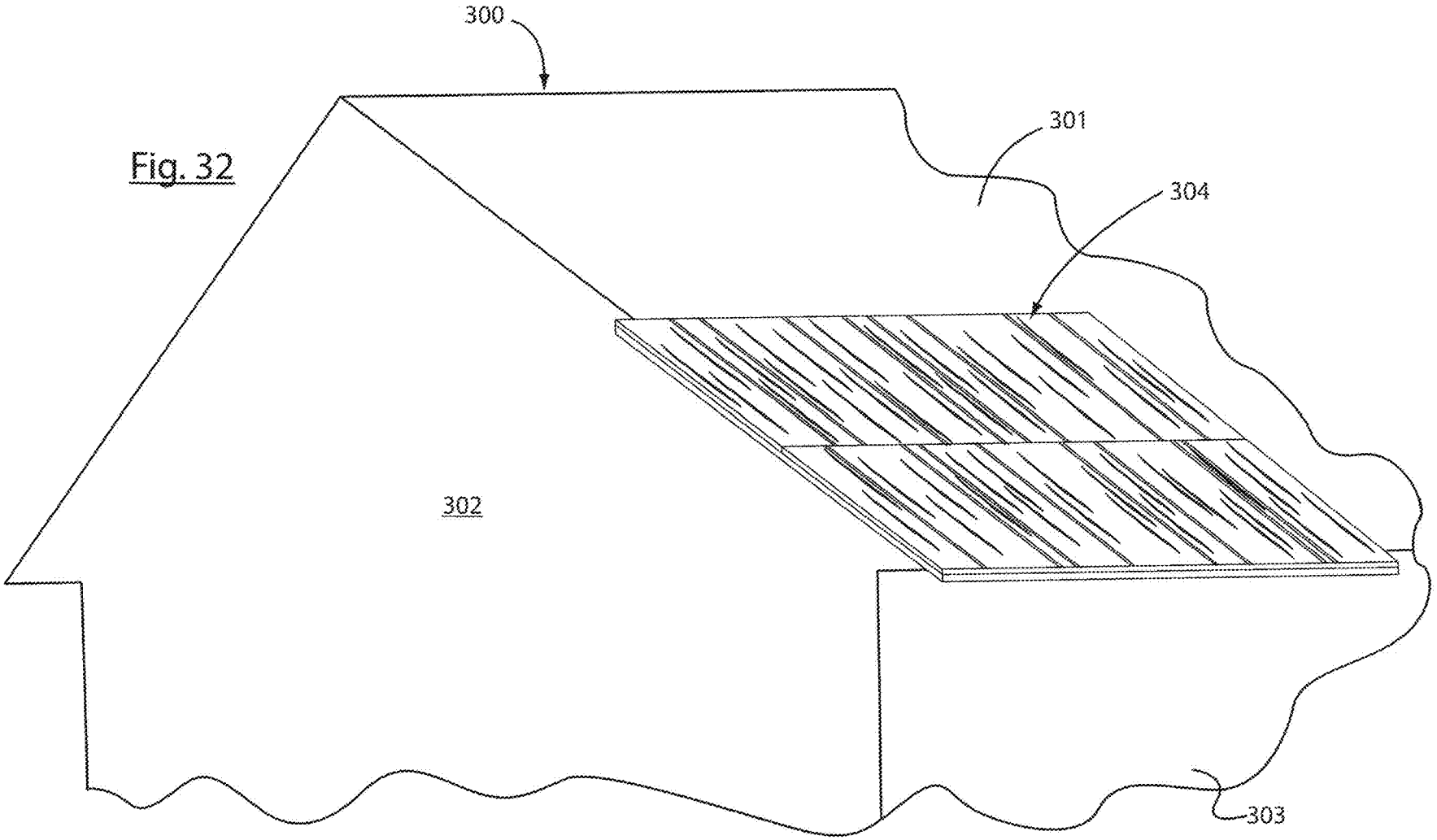

FIG. 32 is a fragmentary perspective view of a building structure having a plurality of panels in accordance with this invention disposed on a surface thereof.

DETAILED DESCRIPTIONS OF THE PREFERRED EMBODIMENTS

Referring now to the drawings in detail, reference is first made to FIG. 1, wherein a panel generally designated 10 of this invention is illustrated. The panel 10 includes a base layer 11 of a molded synthetic polymeric building material that is adapted to be weather-protected in the installed condition on a building structure, and a layer 12 of asphalt based building material.

The layer 11, of polymeric material may be comprised of the thermoplastic material disclosed in U.S. Pat. Nos. 6,808,785; 7,351,462; 7,141,200; 7,141,201, as representative of polymeric materials.

The layer 12 of asphalt based building material may be constructed in accordance with the detailed description of FIG. 6 hereof, for example, or of laminates of materials of the type of FIG. 6, or a material of the type described with reference to FIG. 6 having an additional overlay of adhesive and granules applied to a surface thereof, as representative constructions for the layer 12 of asphalt based building materials.

The polymeric 11 layer of building material may be provided with cut-outs or voids, recesses or the like 13, such as are illustrated in FIGS. 2 and 3, outlined by peripheral ribs 14, 15, 16 and 17, and supported by interior ribs 18, 20, 22 and 23, for providing rigidity to the panel 10, as well as support, so that, for example, in the event that a panel 10 is installed on a roof or the like, installers will be able to safely walk on an exterior surface 24 thereof, without collapsing the panel 10.

The asphalt based building material 12 may be comprised of upper and lower courses 25 and 26 of individual shingles or tiles or portions thereof, with adjacent such individual tabs of shingles or tiles being separated by actual or simulated slots 28 that are generally vertical and spaced apart from each other, to give the overall appearance of a plurality of courses of individual tabs of shingles or tiles 27. In the case of actual slots, the upper surface 30 of the polymeric layer 11 will be exposed and visible through the slots 28. Such exposed portions of the polymeric layer 11 are appropriately stabilized to the environment. In the case of simulated slots, defined by generally vertical lines appearing on the upper surface 24 of the asphalt based layer 12 and on a lower edge of the asphalt based layer 12 as shown in FIG. 2, the lines 28, 32 that define the simulated slots will appear only as aesthetic markings.

As shown in FIG. 1, the right-most edge 33 of the asphalt based layer 12 overlies the right-most edge 34 of the layer of polymeric building material and the lowermost edge 35 of the asphalt based building material layer 12 protrudes below the lowermost edge 36 of the layer of polymeric building material, so that the right edge of the panel 10 as illustrated in FIG. 1 can be in lapped relation with a left-most edge of a next adjacent, substantially identical panel to that 10 of FIG. 1, which adjacent panel is not shown in the illustration of FIG. 1. Similarly, when the panel 10 of FIG. 1 has its lower edge disposed against a next-subjacent panel (not shown), the overlying edge 35 of the asphalt based panel 12 will overly a portion of a layer of polymeric building material of a next-subjacent panel that is similarly constructed to the construction of the panel 10 of FIG. 1.

Thus, the left-most edge 37 of the layer of polymeric building material 11 protrudes beyond the left-most edge 38 of the asphalt based layer 12 of material, and the upper edge 40 of the layer of polymeric building material 11, likewise protrudes above the uppermost 41 of the layer 12 of asphalt based building material, as illustrated in FIG. 1.

It will thus be seen that when panels of the type 10 of FIG. 1 are applied to a surface of a building structure (not shown), next laterally adjacent panels will be in lapped relation to each other, as will be vertically adjacent such panels 10 be in lapped relation to each other.

One or more photovoltaic panel portions 42 may optionally be provided on selected tabs of the upper surface 24 of the asphalt based layer 12 of building material, for capturing photovoltaic energy when the panel 10 is installed on an exterior surface of a building structure, and the photovoltaic panel portions 42 may be provided with wires 43, passing through holes 44 in the panel layers 11, 12, for transmitting photovoltaic energy through panels 10, as illustrated in FIG. 3.

With reference to FIG. 3A, it will be seen that a pair of panels 10 and 10' are shown, with the panel 10' being subjacent to the panel 10, in lapped relation as described above, and wherein wires 43 and 43' for forming the electrical connections between photovoltaic panel portions 42 and 42' for the panels 10 and 10', are connected to each other, passing through the layers 11 and 12 and 11', 12' of respective panels 10 and 10' at 44 and 44', respectively.

Figure 3B:
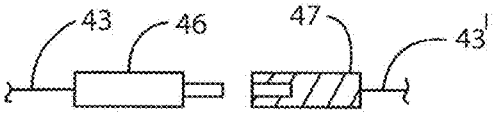
FIG. 3B is an enlarged illustration of a plurality of connector elements for connecting together wires that are present in the individual panels of FIG. 3A, for effecting electrical connection therebetween.

Wire connection devices are provided, for connecting wires 43 and 43' of various panels such as 10 and 10' to each other, from panel-to-panel via connectors 45, in the form of male and female connector elements 46, 47, respectively, for connecting together wires such as those 43, 43' of a pair of panels such as 10, 10' to each other, as shown in FIG. 3B.

At the upper left corner of the illustration of FIG. 1, there is provided a temperature sensor 50, more clearly shown in the detail illustration of FIG. 1A, which temperature sensor 50 is subject to expansion and contraction as a function of temperature, as is the panel, and which sensor provides a visual indication thereon, in the form of the gradations 51 of thermal expansion and contraction characteristics of the panel 10, at a given ambient temperature of the panel 10. For example, the temperature sensor 50 may be constructed in accordance with the disclosure of U.S. Pat. No. 6,939,036, the complete disclosure of which is herein incorporated by reference.

Figure 4:
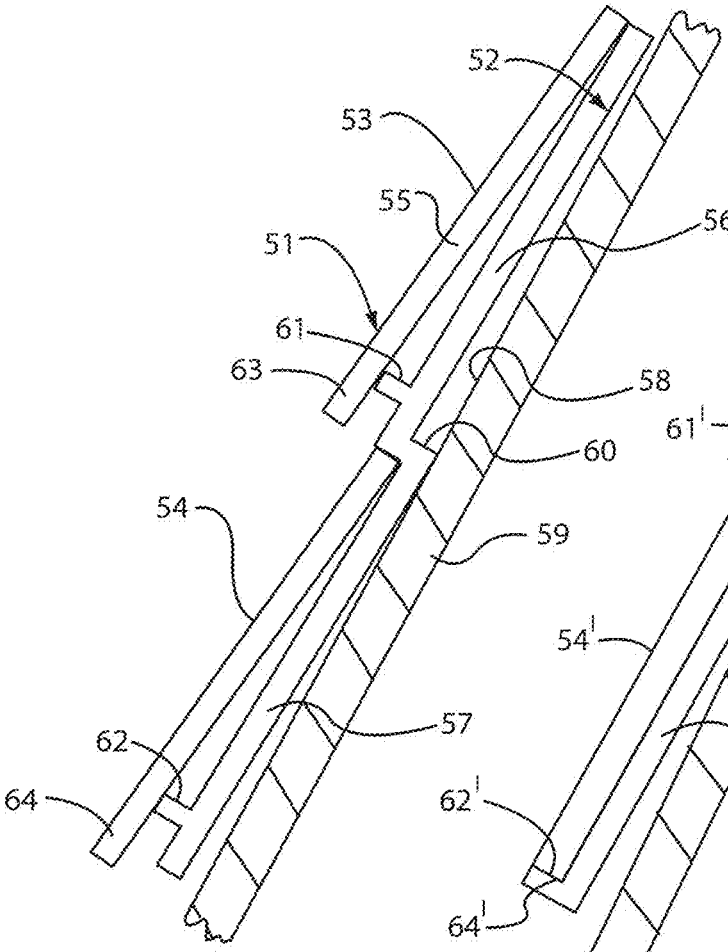
FIG. 4 is a fragmentary vertical sectional view, taken through a roof or side of a building structure, and wherein a panel in accordance with the present invention is illustrated in end view, comprising a polymeric base layer and an overlying layer of asphalt based building material.

With reference now to FIG. 4, it will be seen that a fragmentary portion of a roof or siding structure 59 is illustrated for a building structure, and wherein a panel 51 in accordance with this invention is illustrated. The panel 51 includes a base layer 52 of synthetic, polymeric material, having a plurality of courses 53, 54 of asphalt based building material thereon, shown in edge view in the illustration of FIG. 4. The base layer of synthetic polymeric material is provided with two generally flat portions 56, 57, disposed at acute angles to the surface 58 of the structure 50, offset relative to each other as illustrated at 60, and wherein the portions 56, 57 of the synthetic polymeric layer are each provided with a lip 61, 62 protruding in a generally transverse direction relative to flat portions 56, 57, to engage and support lower ends 63, 64, respectively, of the asphalt based shingles or tiles 53, 54 thereagainst.

Figure 5:
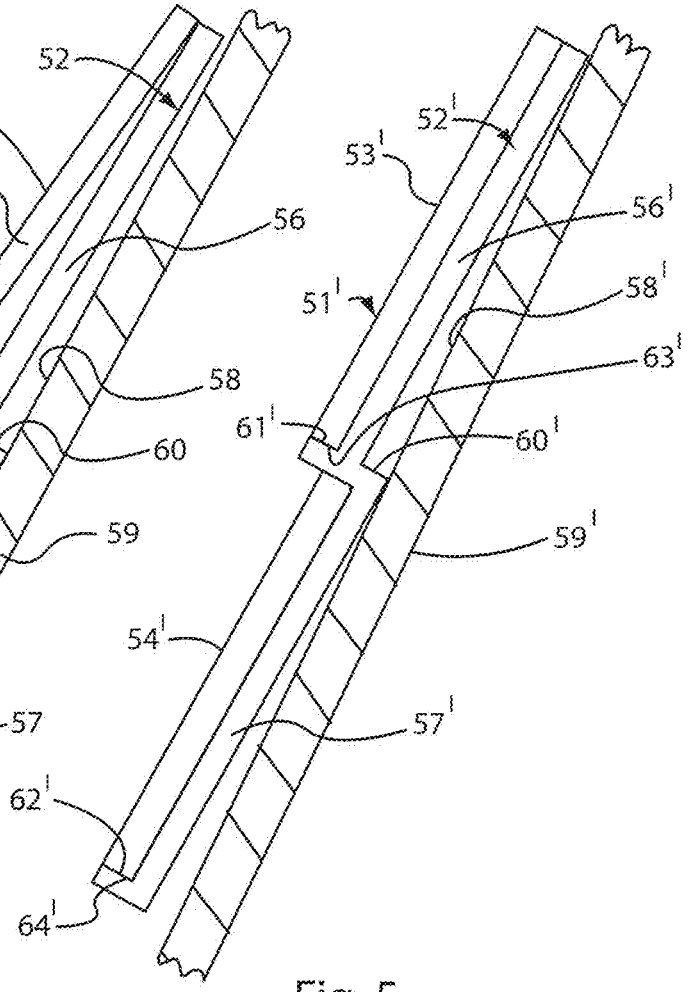
FIG. 5 is an illustration like that of FIG. 4, but wherein the base layer is of a different configuration than that of FIG. 4.

With reference to FIG. 5, similar components and portions of components to those illustrated in FIG. 4 are identified by the numbers 51', 52', 53', 54', 55', 56', 57', 58', 59', 60', 61', 62', 63' and 64', except that the lips 61' and 62' are in underlying relation to lowermost respective edges 63' and 64' of the asphalt based shingle or tile layers 53', 54' seating the shingles or tiles 53', 54' against the flat portions 56', 57' of the synthetic polymeric based building material 52'.

The lips 61, 62 and 61', 62' can be eliminated to yield a shingle appearance and structure like that addressed hereinafter for the shingle of FIG. 29.

Figure 6:
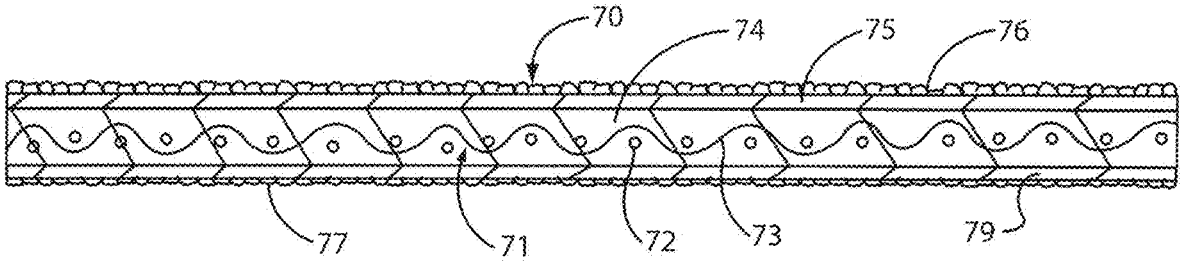
FIG. 6 is a cross-sectional illustration of a typical complete layer of asphalt based building material that would comprise an outer layer of a panel in accordance with the present invention.

Referring now to FIG. 6, there is illustrated a transverse sectional view, taken through a layer of asphalt based building material 70 in accordance with this invention. The material 70 is comprised of a layer of mat 71, which can either be of organic or inorganic construction, but which will preferably be of inorganic construction, generally comprised of a cross-weave of fiberglass strands 72, 73, impregnated with a bituminous material, such as asphalt 74, having an adhesive 75 on an upper surface thereof, which adhesive may also be an asphaltic based (bituminous) adhesive and may or may not comprise the same adhesive material that is the asphaltic material 74, and with a layer of granules 76 on an upper surface thereof, adhered thereto, by the adhesive 75. An adhesive 79 will generally be provided on a lower surface of the mat 71, which adhesive 79 may or may not be the same as the asphalt based adhesive 74. The adhesive 79 will be provided with a layer of fine particles 77 on a lower surface thereof as shown at FIG. 6, which fine particles may be of sand or mica construction or of any other suitable material, which layer of particles 77 will generally be comprised of smaller particles than the granules 76 that appear on the upper surface of the asphalt based building material 70.

Figure 7:
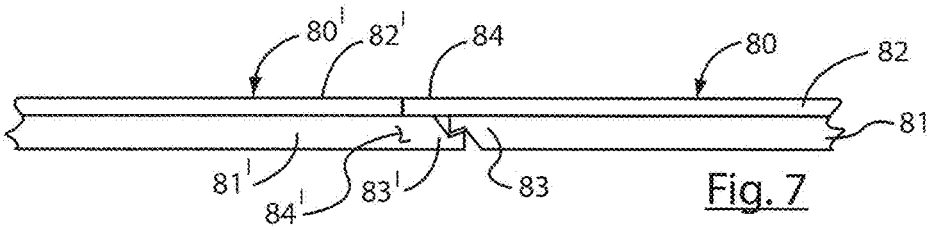
FIGS. 7 and 8 are each fragmentary illustrations of adjacent panels in accordance with this invention, each comprising a base layer of polymeric material and an exterior layer of asphalt based building material, having different adjacent interlocking edges for the base layer of building material.

With reference to FIG. 7, a pair of adjacent panels 80, 80' of this invention are provided, each of which has a base layer 81 or 81' of synthetic polymeric building material and an overlying layer 82 or 82' of asphalt based building material, constructed similarly to that illustrated in FIG. 3A, for example, but wherein adjacent edges 83, 83' of the base layers 81, 81', are lapped in interlocked relation with each other, as shown, and with an edge portion 84 of the asphalt based layer 82 of building material, overlapping a portion 84' of the layer 81' of polymeric based building material. It will be understood that the lapping and interlocking relationship shown in FIG. 7 and as described above can take place between right and left laterally adjacent panels in accordance with this invention, or between vertically adjacent panels in accordance with this invention, or both.

Figure 8:
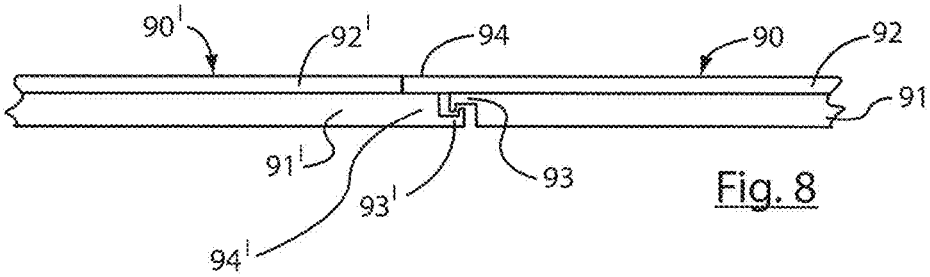

With reference now to FIG. 8, panels 90, 90' in accordance with this invention are illustrated, having similar components to those illustrated in FIG. 7, having synthetic polymeric base layers 91, 91', with asphalt based layers 92, 92' of building materials, with interlocking edges 93, 93' as shown, that differ from the configuration of interlocked edges 83, 83' illustrated in FIG. 7, and wherein the asphalt based layer 92 has an end 94 overlapped with an underlying end 94' of the base layer 91', as shown, with the illustration of FIG. 8 being otherwise similar to the illustration of FIG. 7 discussed above.

Figure 9:
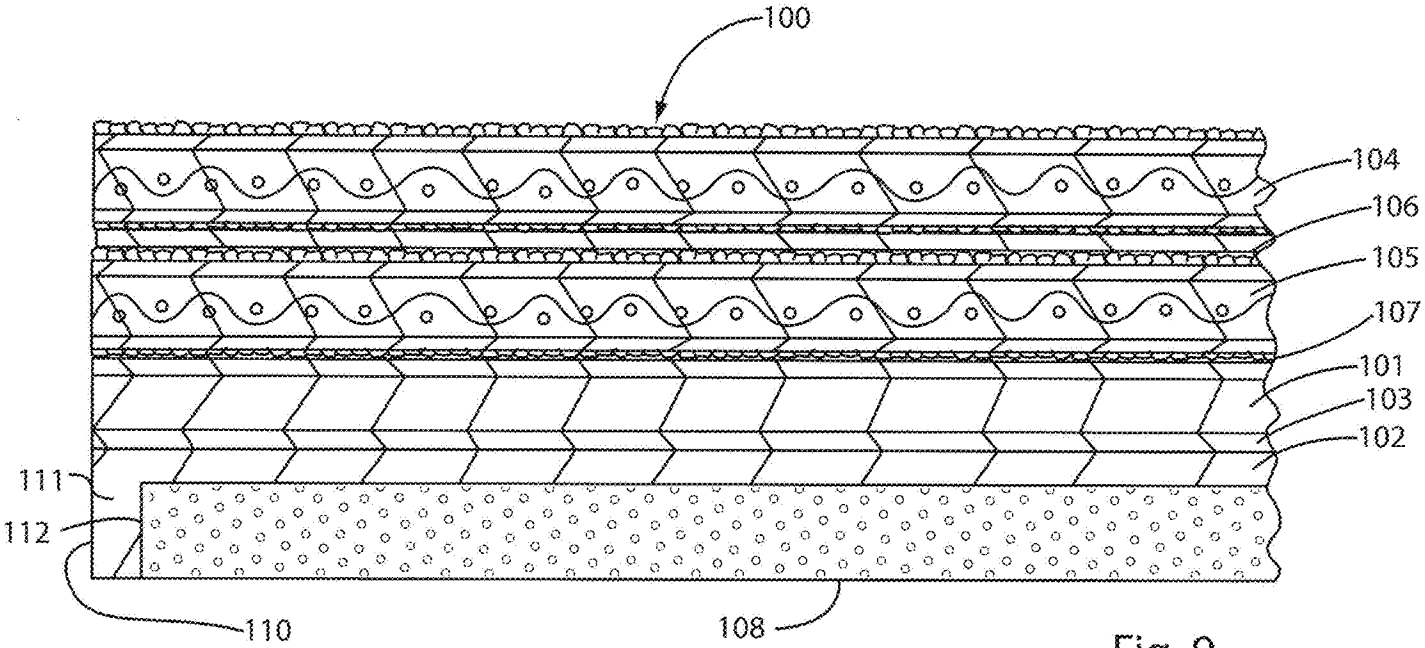
FIG. 9 is a fragmentary cross-sectional illustration of a plurality of base layers of polymeric material, and with a plurality of layers of asphaltic based building material applied thereover, and with a layer of insulation material at the lower end thereof, with the various layers connected by means of adhesives.
Figures 10, 11, 12, 13, 14, 15, 16:
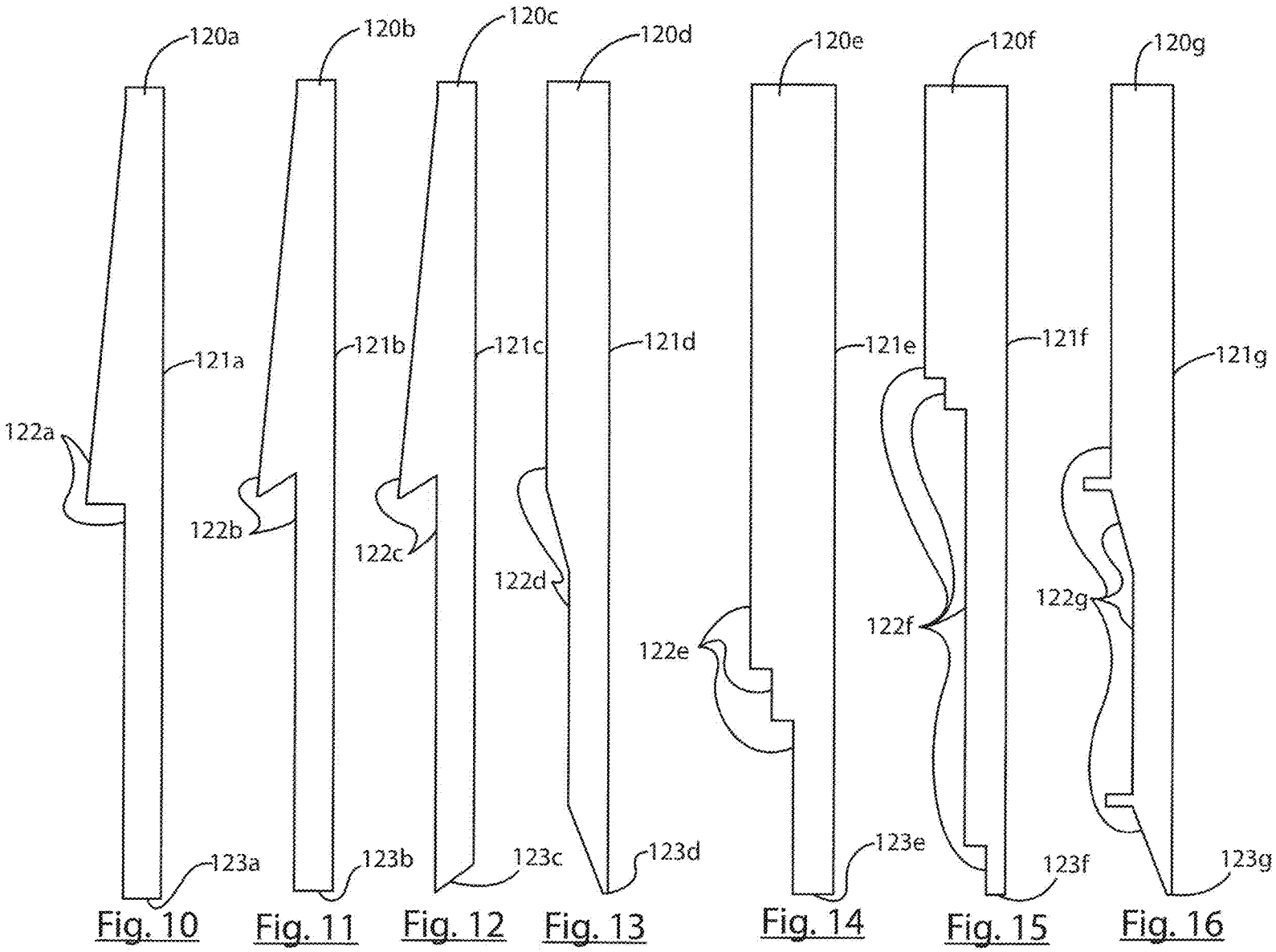
FIGS. 10 through 16 illustrate different side edge views of base layers of panel materials, having different left-facing surface configurations, for application of asphalt based layers of building material thereagainst.

With reference now to FIG. 9, a fragmentary cross section of an alternative panel 100 in accordance with this invention, is illustrated. The panel 100 comprises a pair of base layers of molded synthetic polymeric building material 101 and 102, connected together by an adhesive layer 103. A pair of asphalt based building material layers 104 and 105 are provided, each of which is constructed like the asphalt based building material 70 of FIG. 6, and they are connected together by an adhesive layer 106, with the synthetic polymeric building material layer 101 and the asphalt based building material layer 105 being connected by an adhesive layer 107. Beneath the synthetic polymeric building material layer 102 there is provided a layer 108 of insulation material, preferably a foam type insulation, although the same could be a fiberglass based insulation or made of other insulating materials. The left end 110 of the panel 100 would normally be the end that is the lowermost, generally horizontal edge of the panel 100 when the panel is installed on a building structure. In order to cover the left edge of the insulation layer 108, the left-most end 111 of the polymeric layer 102 covers the edge 112 of the insulation layer, so that the insulation layer's lower edge 112 is not visible from below, when the panel 100 is installed on a building structure, with the end 110 being the lower vertical edge thereof.

FIGS. 10 through 16 are different right edge views of layers of molded synthetic polymeric building material as would be seen by looking at the right edge of each item of building material 120*a*, 120*b*, 120*c*, 120*d*, 120*e*, 120*f*, and 120*g* if their flat surfaces 121*a*, 121*b*, 121*c*, 121*d*, 121*e*, 121*f* and 121*g* were to be installed on an exterior surface of a building structure, leaving their left-most surfaces of various different configurations to have layers of asphalt based building material disposed thereagainst (not shown) and to be the weather-exposed layers of building material, leaving the polymeric building material layers 120*a*, 120*b*, 120*c*, 120*d*, 120*e*, 120*f*, and 120*g* to be the weather-protected layers of building material, and wherein the layers of polymeric building material illustrated in FIGS. 10-16 would be vertically mounted on a building structure (not shown), with their lowermost edges 123*a*, 123*b*, 123*c*, 123*d*, 123*e*, 123*f* or 123*g* being the vertical lowermost edges when mounted on a building structure. Thus, the molded synthetic polymeric building materials, right edge illustrations of which are indicated in FIGS. 10 through 16 present differently configured layers of polymeric building material, adapted to supports layers of asphalt based building material on their outermost surfaces 122*a*, 122*b*, 122*c*, 122*d*, 122*e*, 122*f* or 122*g* when installed on a building structure.

In the fragmentary perspective illustration of FIG. 17 there is provided a panel 125, having a lower layer 126 of synthetic polymeric building material, and an upper layer 127 of asphalt based building material disposed thereover, as a weather-exposed layer, protecting the weather-protected layer 126 of the panel 125. The layer 126 of molded synthetic polymeric material has some lower surface portions 130 in a generally common plane, and other cutback surface portions 128 in yet a different plane, to present a staggered appearance as viewed from the vertical lower edge 131 illustrated in FIG. 17. The edge 131 has a surface that has a plurality of aesthetic configurations 132 molded therein, as shown, and the thickness of the polymeric building material layer 126 is essentially the same, so that upper surfaces are likewise planar and staggered, corresponding to the staggered lower surfaces 128 and 130, as shown. Disposed on the upper surfaces 133 and 134 of the molded synthetic polymeric building material layer 126, are a plurality of asphalt based portions of building material comprising the layer 127, which, because of the various surfaces 133 or 134 on which they are disposed, gives the panel layer 127 an appearance of a staggered thickness, as shown. The upper surfaces 135 of the asphalt based portions of building material are also provided with lines or marks of surface ornamentation 136, as shown, of any desired aesthetic, in order to give the various simulated shingles or tiles that comprise the asphalt based exterior of the panel 125 the appearance of natural slate, shake materials, or of other natural materials, as may be desired.

In lieu of staggered lower surfaces 128 and 130, the bottom surface of the shingle could be in the same plane, like the bottom surfaces of the shingles depicted in FIGS. 29 and 30, but with the top surface portions of the shingle of FIG. 17 in different planes, as shown.

With reference now to FIG. 18, there is provided a lower edge view of a panel similar to that of FIG. 2, but wherein the panel 140 is provided with two layers of molded synthetic polymeric building material 141 and 142, with the layer 142 being constructed like the layer 13 of FIG. 2, so that the details of construction of that layer 142 need not be duplicated herein. The layer 141 of molded synthetic polymeric building material is disposed against an upper surface of the layer 142 of polymeric building material, secured thereto by means of a suitable adhesive (not shown). The layer 143 of asphalt based building material is constructed similarly to the construction of the layer 12 of the asphalt based building material illustrated in FIG. 2, so such also need not be duplicated herein. In lieu of or in addition to the layers 141 and 142 being adhesively connected, they could be heat laminated together or co-extruded, so that they are secured to each other.

The two polymeric layers 141 and 142 enable various ornamental effects, for example, the outer-facing surface 149 of the layer 141 could be provided with a different type of shading, such as for example only, a darker shading, to be visible through slots 144 between adjacent shingle or tile tabs that comprise the asphalt-based layer 143, if desired.

With reference to FIG. 19, an alternative perspective view of a panel is illustrated, fragmentally shown, and which comprises a lower layer of synthetic polymeric building material 150, having an asphalt based layer 151 applied thereover, presenting what appears as a lower course of shingles, and with another layer of asphalt based building material 152 applied at the upper end of the panel 153, as a separate course. Notches 154 and 155 are provided in the layers of material that make up the two courses illustrated in FIG. 19, for a different aesthetic effect.

In FIG. 20, the panel 160 is illustrated as having a lower layer of molded synthetic polymeric building material 161, configured in the form of a series of barrel tiles, with the lower course 162 having an upper layer 163 of asphalt based building material thereover, likewise configured to present the appearance of barrel tiles, and with the upper course 164 of tiles having another layer 165 of asphalt based building material thereover, so that the courses 162, 164 give the appearance of lapped barrel tiles, as shown.

With reference now to FIG. 21, there is illustrated a front view of another embodiment of a panel 170 in accordance with this invention. The panel 170 is comprised of a base layer of molded synthetic polymeric building material (not shown), having either a plurality of shingle or tile tabs such as 171, 172, 173, 174, 175, as shown, with the shingle or tile tabs having slots 176 therebetween, to give the appearance of individual shingles or tiles. Alternatively, the lines shown that comprise the slots 176 could be applied lines of demarcation, that do not represent actual slots, but which visually simulate slots, applied to the exterior surface 177 of the asphalt based layer of shingle material. The panel 170 of FIG. 21 does not show lapped edges, although it will be understood that the same could be provided, as are disclosed with reference to the panel 10 of FIG. 1. Also, the panel 170 of FIG. 21 does not show photovoltaic elements such as those 42 for the panel 10 of FIG. 1, nor a temperature sensor, such as that 50 shown for the panel 10 of FIG. 1, although the same could be provided, if desired.

The panel 170 is provided with lines, grooves, or other surface indicia 178, as may be desired, on the outer surface 177 thereof, to simulate natural materials, such as cedar shakes, slate, or other ornamentation, as may be desired.

In FIG. 22, there is illustrated a panel 180, similar to the panel 125 of FIG. 17, so the same will not be described in detail herein, except that it will be noted that the lower edge 181 of the synthetic polymeric layer 182 of building material is not provided with edge indicia thereon, like the aesthetic edge indicia 132 illustrated for the panel 125 of FIG. 17.

In FIG. 23, there is illustrated a layer of asphalt based building material for application against a layer of molded synthetic polymeric building material (not shown), but wherein the layer 185 comprises a continuous sheet of asphalt based building material, having no vertical slots, but having a lower edge 186 with a plurality of cutouts 187 therein, for a different aesthetic effect for a weather-exposed layer of asphalt based building material that can be used with a panel in accordance with this invention, and wherein the layer 185 of asphalt based building material will preferably have a cross-sectional structure like the layer 70 of asphalt based building material of FIG. 6.

With reference now to FIG. 24, it will be seen that the same illustrates a pair of upper and lower panels 190, 190' are shown from the rear, or underside, similar to the panels 10 and 10' of FIG. 3A, also with overlapping asphalt based top and side protrusions 191, 192 and 192' comprised of asphalt based building material layers, for overlapping edges of vertically or laterally adjacent molded synthetic polymeric building material layers that would disposed thereagainst (not shown).

The panels 190, 190' would preferably be provided with recesses 193 and 193', as shown, in the rear surfaces of the panels 190, 190', preferably circumscribed by peripheral ribs 194, 195, 196 and 197 and peripheral ribs 194', 195', 196' and 197', and by interior ribs 198, 200, 201, 202 and 198', 200', 201' and 202', functioning in the same manner as the peripheral and interior ribs disclosed above with respect to the illustration of FIG. 3.

In the embodiment of FIG. 24, the above-mentioned peripheral and interior ribs are provided with passageways 203, 204, 205, 206, 207, 208 for the panel 190 and with passage ways 203', 204', 205', 206', 207' and 208', for the panel 190'. These passageways allow for and facilitate the passage of air therethrough, as illustrated by the arrow configurations 210, 211, 212 and 213, for enabling the cooling of roofing and siding panels that may otherwise be subject to accumulation of excessive heat thereunder, as for example, when the panels are subjected to warm weather conditions when installed on a building structure in a hot environment.

It will be understood that the panels of this invention may be installed on a structure with a lateral offset between subjacent and superjacent courses. Further, in the case of embodiments such as that depicted in FIG. 24, the lateral offset may be selected such that the passages 203 through 208 align with similar such passages of panels of a subjacent or superjacent course.

In FIG. 25 there is illustrated a sectional view of a panel 140, of the type of FIG. 18 comprising an asphalt based panel layer 143 overlying an upper synthetic polymeric panel layer 141, secured thereto, which panel layer 141 overlies another synthetic polymeric layer 142 having recesses 145 therein, and peripheral and interior ribs 146, 147, with right and left edges of the polymeric layer 141 terminating at right and left edges of the peripheral ribs 146, as illustrated.

Similar components to those described above for the illustration of FIG. 25, are correspondingly numbered as 140', 141', 142', 143', 144', 145', 146' and 147' in the embodiment of FIG. 26. It will be noted that the polymeric panel layers 141' and 142' are likewise secured together, as are comparable panel layers for the embodiment of FIG. 25. The polymeric layers 141 and 142 can be adhesive secured together or heat laminated or co-extruded, so that they are secured together.

In the embodiment of FIG. 26, depending transverse portions 148' and 149' of the polymeric layer 141' cover peripheral ribs 146' of the polymeric layer 142', to provide an alternative panel edge configuration.

FIG. 27 illustrates another panel 210 in accordance with this invention. The panel 210 includes a base layer of polymeric building material 211, having two courses 212 and 213 each comprised of double layers of asphalt based building material 214, 215 and 216, 217, the layer 214 being adhesively secured to the layer 215, and corresponding layers 216 and 217, also of asphalt based building material, with the layer 216 overlying and being adhesively secured to the layer 217.

It will be noted that the layer 215 has a lower edge 218 that protrudes outwardly, extending lower than the edge 220 of the layer 214, in a petticoat effect.

Similar to the course 214, the lower asphalt based layer 217 has a lower edge 221 that protrudes outwardly below the lower edge 222 of the layer 216, also in a petticoat effect. Slots 223 and 224 appear in layers 214 and 216, such that the upwardly facing surfaces of layers 215 and 217 will be visible through the slots 223 and 224. If the upper surfaces of asphalt based layers 215 and 217 are darker than the upper surfaces of the layers 214 and 216, such darkness will appear not only through the slots 223 and 224, but also at the lower edges 218 and 221 having the petticoat effect, in order to produce a visual contrast for the two asphalt based courses 212 and 213. Additionally, notches 225 and 226 may appear throughout the several layers, as shown, at the lower ends of the slots 223 and 224, with the notches 225 and 226 being present not only in the upper asphalt based layers 214 and 216, but preferably in all layers illustrated in FIG. 27.

In the fragmentary illustration of FIG. 28, the panel 230 is comprised of an upper asphalt based layer 231 and a lower polymeric layer 232. In this embodiment, the polymeric layer 232 has its lower edge 233 protruding out past the lower edge 234 of the asphalt based upper layer, also producing a petticoat effect. In the embodiment of FIG. 28, the upper surface 235 of the polymeric layer 232 may, if desired, be of a darker shading than the upper surface 236 of the asphalt based layer 231, to produce a contrast not only with the petticoat effect described above, but also to provide a darker contrast through the slots 237 in the upper asphalt based layer 231. In the instance where portions of the polymeric layer 232 are to be exposed to the elements, it will be understood that suitable stabilizer packages may be incorporated into the surface layer(s) of the polymeric layer 232.

In FIG. 29, there is illustrated a synthetic polymeric base layer 250 for the panel 251, and a pair of asphalt based layers 252 and 253, as shown, with an edge portion 254 of layer 252 overlying an edge portion 255 of layer 253. As indicated in the enlarged detail view of FIG. 29A, to the left of edge 252 there is provided a shadow line effect 256, comprised of a band of adhesive to the left of edge 254, securing to the upper surface of layer 253 a band of granules thereon. Typically, the shadow line 256 produced by the band of granules will be comprised of granules that are darker than any granules that appear on the upper surfaces of the layers 252 and 253. It will also be understood that the panel 251 of FIG. 29 is shown as a right side view of a panel, that would normally be installed on a building structure, with panel edge 257 being vertically located above the opposite edge 258, with the edge 258 thereby being a lower edge when the panel 251 is installed on a vertical surface of a building structure, or on a sloped roof of a building structure. It will also be understood that a shadow effect 256 may also be accomplished by local deposition of a stripe of darker granules in the location of the desired shadow line during manufacture of the asphalt based layer 70 of FIG. 6.

FIG. 30 illustrates in fragmentary view, a panel 260 in accordance with this invention, wherein the panels base layer 261 is of polymeric building material, and is provided with a plurality of planes 262, 263, 264, 265, 266, for example, that have different angular relations to each other, to produce a staggered, or random effect, and that asphalt based layer components, 267, 268, 270, 271 and 272 are disposed thereover, again adhesively secured thereto, to give a random-appearing effect simulating natural cedar shake, slate, or tile effects.

In the exploded view of FIG. 31 there is illustrated a plurality of layers that comprise a building panel 280 in accordance with this invention, such layers comprising lowermost polymeric layer 281 adhesively secured beneath polymeric layer 282, by an adhesive 283. The polymeric layer 282 is secured beneath an asphalt based layer 284 by means of an adhesive 285. The upper surface 286 of asphalt based layer 284, shown with a plurality of dots thereon, is intended to show, as a drafting expedient, that the surface 286 may be generally of a uniform darker appearance, such that, when it is adhered beneath uppermost asphalt based layer 287, the darker surface 286 will be visible through the slots 288 and 290 in the courses 291, 292 of shingles, tiles or the like that comprise the asphalt based layer 287. It will be seen that the lower edges 293 of the shingles or tiles in course 291 overly the upper edges 294 of shingles or tiles that comprise the course 292. Both courses 291 and 292 of shingles or tiles are adhesively secured to the asphalt based layer 284, by an adhesive 295.

With reference to FIG. 32, it will be seen that a building structure 300 is provided, with a roof 301, an end wall 302 and a sidewall 303. A panel 304 in accordance with any of the embodiments in accordance with this invention is disclosed positioned on the sloped surface of the roof 301, although the panel 304 could equally well be located vertically, on the surface 303 or 302 of the building structure 300. It will also be understood that a plurality of such panels would be used, preferably with overlapping edges, to cover the entirety of the roof 301 and/or the entirety of one or more sidewalls 303 or end walls 302, as will be understood from all of the foregoing.

Shingles in accordance with this invention, wherein an asphalt based layer overlies at least a major portion of a polymeric layer, leaving exposed some portion(s) of the polymeric layer, may be made to emulate any of a wide range of shingle appearances or aesthetics as disclosed in the illustrations herein, or which are well known in the roofing art, such as but not limited to those of U.S. Pat. Nos. 6,038,826; 6,044,608; 6,205.734; 6,467,235; 6,523,316; and 6,920,730, the complete disclosures of which are herein incorporated by reference.

It will also be understood that when shingle panels in accordance with this invention are applied to a roof, either in the same course or in subjacent or superjacent courses, such adjacent, subjacent or superjacent panels can have portions of their left or right sides and/or top and/or bottom edges offset from each other, or such sides or edges can be at any of selected diagonal orientations, or in shiplapped or interlocked relation to next adjacent, subjacent or superjacent panels.

It will further be understood that variations may be made in the details of construction, as well as in the use and operation of panels in accordance with this invention, as well as in a building structure employing such panels, all within the spirit and scope of the invention as defined in the appended claims.

What is claimed is:

1. A building structure comprising a roof, the roof having an exterior covering disposed thereon comprising a plurality of building panels disposed on a building surface, each panel comprising:

a top edge disposed toward a top of the building structure, a bottom edge disposed toward a bottom of the building structure, a first lateral edge and second opposed lateral edge;

a base structure comprised of a molded synthetic polymeric building material, the base structure having an interior side disposed against the building surface and an exterior side;

an asphalt-based layer, the asphalt-based layer being formed of one or more discrete components of asphalt-based building material, each discrete component of asphalt-based building material having an outer side and an inner side, the inner side being disposed against and secured to the exterior side of the base structure, and comprising a layer of mat impregnated with an asphalt material and having a layer of granules on at least one side of the layer of mat, the layer of granules being secured to the asphalt material, the layer of granules being at the outer side of each discrete component of asphalt-based building material;

wherein the asphalt-based layer extends beyond the base structure at the first lateral edge, and does not extend beyond the base structure at the second lateral edge;

wherein the outer side of the asphalt-based layer includes visible lines of demarcation visually delineating the appearance of a plurality of generally horizontal courses of roofing elements selected from shingles, tiles, slates and shakes, and includes within each delineated generally horizontal course of roofing elements, generally vertical lines of demarcation visually delineating the appearance of a plurality of roofing elements laterally disposed within each said course of shingles or tiles;

wherein the plurality of building panels includes a first panel and a second panel disposed horizontally adjacent the first panel, with the asphalt-based layer at the first lateral edge of the first panel overlapping the second panel at the second lateral edge thereof, and with the base structure of the first panel at the first lateral edge thereof being disposed horizontally adjacent to the base structure of the second panel at the second lateral edge thereof.

2. The building structure according to claim 1, wherein the base structure of the first panel at the first lateral edge thereof is disposed horizontally adjacent to the base structure of the second panel at the second lateral edge thereof in an abutting relationship.

3. The building structure according to claim 1, wherein the base structure of the first panel at the first lateral edge thereof is disposed horizontally adjacent to the base structure of the second panel at a second lateral edge thereof in an interlocking relationship.

4. The building structure according to claim 1, wherein in each building panel the base structure extends beyond the asphalt-based layer at the second lateral edge thereof, such that the asphalt-based layer at the first lateral edge of the first panel overlapping the second panel at the second lateral edge thereof by being disposed on the portion of the base structure of the second panel that extends beyond the asphalt-based layer of the second panel at the second lateral edge thereof.

5. The building structure according to claim 1, wherein in each building panel the asphalt-based layer extends beyond the base structure at a first medial edge selected from one of the top edge and the bottom edge, and does not extend beyond the base structure at a second medial edge that is the other of the top edge and the bottom edge; and wherein the plurality of building panels further includes a third panel disposed vertically adjacent the first panel, with the asphalt-based layer at the first medial edge of the first panel overlapping the third panel at the second medial edge thereof, and with the base structure of the first panel at the first medial edge thereof being disposed vertically adjacent to the base structure of the third panel at a second medial edge thereof.

6. The building structure according to claim 5, wherein in each building panel the base structure extends beyond the asphalt-based layer at the second medial edge thereof, such that the asphalt-based layer at the first medial edge of the first panel overlapping the third panel at the second medial edge thereof by being disposed on the portion of the base structure of the third panel that extends beyond the asphalt-based layer of the third panel at the second medial edge thereof.

7. The building structure according to claim 1, wherein in each building panel, the base structure includes on the interior side thereof a plurality of peripheral ribs and a plurality of interior ribs configured to provide rigidity and support to the panel.

8. The building structure according to claim 7, wherein the peripheral ribs and the interior ribs have passageways formed therein to allow for passage of air therethrough.

9. The building structure according to claim 1, wherein each building panel further comprises an insulation layer secured on the interior side of the base structure.

10. The building structure according to claim 1, wherein in each building panel the interior side of the base structure has a recess formed therein, thereby reducing the weight of the panel.

11. The building structure according to claim 1, wherein in each building panel the base structure is made of a polymer selected from polyethylene, polypropylene, polybutylene, polymethylpentene, a polyacrylate, polyethyleneterephthalate, polybutyleneterephthalate, polyethylenenaphthalate, ethylene-propylene-diene monomer copolymers, or a copolymer, binary or ternary blend of any such polymer.

12. The building structure according to claim 1, wherein in each building panel, the asphalt-based layer simulates a plurality of roofing elements selected from natural shakes, natural slates, tiles and shingles, the roofing elements having visible weather-exposed tab portions and being disposed in multiple, vertically adjacent horizontal courses, with multiple side-by-side individual roofing elements in each horizontal course.

13. The building structure according to claim 1, wherein the asphalt based building material comprises multiple components of asphalt based building material.

14. The building structure according to claim 1, wherein at least one of said base structure and asphalt based building material are provided with notches at lowermost ends of the generally vertical lines of demarcation.

15. The building structure according to claim 1, wherein adjacent the visible lines of demarcation, there is provided a stripe of darker granules, darker in appearance than the surrounding granules of the layer of granules, on the outer side of the asphalt based building material, comprising means providing a shadow line effect.

16. The building structure according to claim 1, wherein the base structure has a flat portion, with at least one generally transverse lip at an angle to the generally flat portion, to engage and support an edge of asphalt based building material thereagainst.

17. The building structure according to claim 1, wherein the exterior side of the base structure is provided with a plurality of planes comprising any one of:

(i) planes that are parallel to each other;

(ii) planes that are non-parallel to each other;

(iii) planes that are parallel to each other with lips that are generally transverse to those planes; and (iv) planes that are parallel or non-parallel to each other, and which are intersected by at least one plane that is at an angle to at least one of the other planes.

18. The building structure according to claim 1, wherein the asphalt-based layer is provided with a plurality of generally vertical slots, disposed generally parallel to each other and wherein portions of the base structure are visible through said slots.

19. The building structure according to claim 1, wherein the base structure has some portions of any of:

(i) different thicknesses; and (ii) portions of the exterior side thereof that are at different angles relative to each other.

20. The building structure according to claim 1, wherein the asphalt-based layer simulates any one of:

(i) wooden shakes;

(ii) natural slate;

(iii) an embossed outer side;

and (iv) a petticoat effect, whereby an underlying layer has a portion protruding below a lowermost edge of an overlying layer of asphalt based building material.

* * * * *